US005630395A

United States Patent [19]

Katoh et al.

[11] Patent Number: 5,630,395

[45] Date of Patent: May 20, 1997

[54] FEEDBACK CONTROL SYSTEM FOR MARINE PROPULSION ENGINE

[75] Inventors: Masahiko Katoh; Kimihiro Nonaka; Kazuhiro Nakamura, all of Hamamatsu, Japan

[73] Assignee: Sanshin Kogyo Kabushiki Kaisha, Hamamatsu, Japan

[21] Appl. No.: 575,221

[22] Filed: Dec. 20, 1995

Related U.S. Application Data

[63] Continuation-in-part of Ser. No. 402,193, Mar. 10, 1995.

[30] Foreign Application Priority Data

| | | | |
|---|---|---|---|
| Mar. 10, 1994 | [JP] | Japan | 6-40065 |
| Mar. 10, 1994 | [JP] | Japan | 6-40066 |
| Mar. 10, 1994 | [JP] | Japan | 6-40067 |
| Mar. 10, 1994 | [JP] | Japan | 6-40068 |
| Dec. 22, 1994 | [JP] | Japan | 6-320029 |

[51] Int. Cl.[6] ..... F02P 5/00

[52] U.S. Cl. ..... 123/406

[58] Field of Search ..... 123/406, 676, 123/492, 478; 60/571; 440/1

[56] References Cited

U.S. PATENT DOCUMENTS

| | | | |
|---|---|---|---|
| 4,909,764 | 3/1990 | Hirukawa et al. | 440/1 |
| 5,327,866 | 7/1994 | Kitajima | 123/406 |
| 5,327,867 | 7/1994 | Hisaki et al. | 123/406 |

*Primary Examiner*—Raymond A. Nelli

*Attorney, Agent, or Firm*—Knobbe, Martens, Olson & Bear LLP

[57] ABSTRACT

A number of embodiments of feedback control systems for maintaining the desired air fuel ratio in a marine propulsion engine that has an exhaust system for exhausting the exhaust gases to the atmosphere through an underwater exhaust gas discharge and wherein the discharge is adjustable relative to the associated watercraft. Hull conditions which will change the engine performance are measured and the amount of fuel air ratio supplied to the engine by a feedback control system is varied, depending upon the sensed airflow and the sensed condition that may affect engine performance and, accordingly, the ideal air fuel ratio. Spark ignition timing is also changed and the air fuel ratio may be corrected depending upon exhaust back pressure.

28 Claims, 18 Drawing Sheets

Fuel Injection Duration Amount

FEEDBACK CONTROL SYSTEM FOR MARINE PROPULSION ENGINE

CROSS REFERENCE TO RELATED APPLICATION

This application is a Continuation-in Part of my copending application of the same title, Ser. No. 08/402,193, filed Mar. 10, 1995, and assigned to the assignee hereof.

BACKGROUND OF THE INVENTION

This invention relates to an engine control system and method and more particularly to an improved feedback control system and method for a marine propulsion engine.

The control of an engine is extremely important in ensuring good running. In addition to providing the appropriate and desired output for the engine under a wide variety of running conditions, engine control is important in ensuring good fuel economy and also effective exhaust emission control. Therefore, it has been proposed to provide engines with sensors which sense the actual air-fuel ratio of the engine and make adjustments through a feedback control system so as to ensure that the air-fuel ratio is obtained at the desired amount.

Although this theory may be relatively simple, the application of this principle is not quite as straightforward. The problem is particularly acute in conjunction with marine propulsion engines. Unlike land vehicles, very nature of a watercraft and its systems can have a greater effect on the engine performance than a land vehicle. That is, many characteristics of the vehicle condition can have a significant effect on the engine itself and the proper control for the engine. This is also true if feed back control is employed.

For example the exhaust gases from a marine propulsion engine are frequently discharged, under at least some running conditions, below the level of water in which the associated watercraft is operating. This underwater exhaust gas discharge is employed so as to assist in exhaust silencing.

With land vehicles the condition at the exhaust discharge generally is maintained fairly constant under all running conditions. That is, there are not outside factors which will affect the ability of the exhaust system to discharge the exhaust gases under most normal conditions. However, when the exhaust gases are discharged beneath the water, as with a marine propulsion engine, then the condition at the exhaust outlet can vary significantly.

One way in which the condition can vary is that the depth of the underwater exhaust gas discharge is not constant during the running of the watercraft that is powered by the engine. In fact, the variations are not even linear in relation to speed. The reason for this is that many watercraft use so-called "planing-type" hulls that operate fairly deeply submerged under low-speed conditions. However, as the speed increases and the watercraft goes on plane, the water level can change suddenly relative to the location of the exhaust gas outlet. This can have a significant effect on the performance.

Also it is the practice to change the trim of the propulsion unit during running. This is done to achieve the optimum angle of attack for the propeller and the optimum angle also does not vary linearly with speed. The trim angle also affects the exhaust path to reach the atmosphere. Thus trim angle also affects engine performance.

It is, therefore, a principal object of this invention to provide an improved feedback control for a marine propulsion engine that takes into account the watercraft conditions such as depth of running and trim angle.

It is a further object of this invention to provide an improved feedback control for a marine propulsion engine wherein the depth of submersion of the exhaust outlet and its trim angle is factored into the feedback control variables.

In addition to the depth of the exhaust outlet in marine applications, the exhaust gases are frequently discharged, particularly under high-speed operation, through a through-the-propeller or through-the-hub exhaust gas discharge. However and as has been noted, when the watercraft is propelled by a propeller, it is the normal practice to mount the propeller so that its trim position can be adjusted. That is, the angle of axis of rotation of the propeller relative to the transom is varied. This is done both in outboard motors and in the outboard drive portion of an inboard/outboard drive. These types of drives are referred to generally as marine outboard drives.

In addition to changing the depth of submersion, the trim adjustment changes the angle at which the exhaust gases are discharged relative to the water level. Hence, the back pressure on the exhaust gases can vary with the trim angle, even if the depth is maintained uniform.

It is, therefore, a still further object of this invention to provide an improved feedback control for a marine propulsion engine wherein the trim angle of the drive is considered in setting the feedback control.

With water vehicles and those having under water exhaust discharges the back pressure on the exhaust outlet also varies even if the depth and trim are not adjusted. The engine frequently gains speed faster than the boat. Hence on acceleration the amount of exhaust gasses discharged increases faster than the watercraft speed. As the watercraft speed increases the pressure at the exhaust outlet will go down, other factors being held equal. However during acceleration and at least at the initial phases of acceleration the exhaust back pressure may go up even more than expected.

It is therefore still another object of this invention to provide a feed back engine control system and method that is responsive to transient watercraft conditions.

The types of feedback control employed generally control the air-fuel mixture by controlling the amount of fuel in response to the output of the sensor. The sensor is frequently an exhaust sensor, such as an $O_2$ sensor, that emits a signal which is indicative of the richness or leanness of the mixture. If the feedback control is done only as a function of the output of this sensor, the control may not be as effective because it disregards the other factors noted above.

It is, therefore, a still further object of this invention to provide an improved feedback control system and method for a marine propulsion engine that takes into account watercraft conditions that will affect engine performance.

In addition to trim adjustment, many watercraft also permit or effect height adjustment of the propulsion unit. From the foregoing discussion it should be apparent that height changes will also affect engine performance.

It is, therefore, a still further object of the invention to provide an engine feed back control system and method that compensates for changes in the height of the propulsion unit.

It has also been discovered that merely changing the amount of fuel supplied to the engine does not necessarily achieve the complete results desired. For example, with spark-ignited engines it has been found that the spark advance should also be altered in response to the feedback signal. Like the fuel-ratio variation, spark advance control also depends upon factors of watercraft condition that may affect engine operation.

It is, therefore, a still further object of this invention to provide an improved feedback control system for the spark timing which is dependent upon factors affecting exhaust performance such as conditions of the powered watercraft.

In controlling the air-fuel ratio, it is necessary, of course, to provide a good indication of air flow to the engine so that the fuel flow that is varied can be varied in proportion to air flow. With two-cycle engines, a type of engine frequently employed in marine propulsion applications, it has been noted that the amount of air flow to the engine can be accurately determined by measuring the pressure in the crankcase chamber at particular crank angles. Therefore, many engine control systems employ crankcase pressure sensors so as to control the amount of fuel supplied.

It has been discovered, however, that the exhaust back pressure also can vary the accuracy of the crankcase pressure sensor in determining the accurate airflow to the engine.

It is, therefore, a still further object of this invention to provide an improved feedback control system where the airflow is measured by crankcase pressure and wherein adjustments are made in the air flow determination based upon factors which affect the back pressure in the exhaust system.

In engines that have plural cylinders, frequently the engine is supplied with an exhaust system that includes a manifold that collects exhaust gases from a number of exhaust ports and delivers it to the atmosphere through a common exhaust gas opening of the exhaust system. With these systems and with particular applications the distance between the exhaust gas opening and the exhaust ports of the individual cylinders may be different. This is a problem that is particularly acute in conjunction with marine propulsion applications due to the compact nature of the exhaust system that must be employed for these applications.

This difference in length can be particularly significant in conjunction with two-cycle engines, wherein exhaust pulses can have a significant effect on the charging of the individual cylinders. This is caused in part by the substantial overlap between the opening of the scavenge port and the closing of the exhaust port. When utilizing a feedback control, the collected flow of the exhaust gases is normally measured, and this is used for determining the air-fuel ratio. As a result, although the average for the system may be acceptable, individual cylinders are not supplied with the appropriate air-fuel mixture.

It is, therefore, a still further object of this invention to provide an improved feedback control system for an engine having plural cylinders served by a common exhaust system and wherein the feedback control is varied on a cylinder-by-cylinder basis.

SUMMARY OF THE INVENTION

First features of the invention are adapted to be embodied in a fuel control method and apparatus for a marine propulsion internal combustion engine. The engine is provided with a at least one combustion chamber. An air and fuel charging system is provided for supplying fuel and air to the engine combustion chamber for combustion. The engine has an exhaust system for discharging combustion products from the combustion chamber to the atmosphere. The engine is mounted on a hull and drives a propulsion device carried by the hull for propelling the hull. A combustion condition sensor is provided for sensing the combustion conditions in the engine. In addition a hull condition sensor is provided for sensing a hull condition that will also affect engine performance.

In accordance with a method for practicing this invention, the output of the combustion condition sensor is employed for adjusting at least one of the engine systems to maintain the desired combustion condition. The hull condition sensor is also utilized to control the combustion adjustment when hull condition will affect combustion.

In accordance with an apparatus for practicing this invention, the output of the combustion condition sensor is employed for adjusting at least one of the engine systems to maintain the desired combustion condition. The hull condition sensor is also utilized to control the combustion adjustment when hull condition will affect combustion

DETAILED DESCRIPTION OF THE PREFERRED EMBODIMENTS OF THE INVENTION

Figure 1:
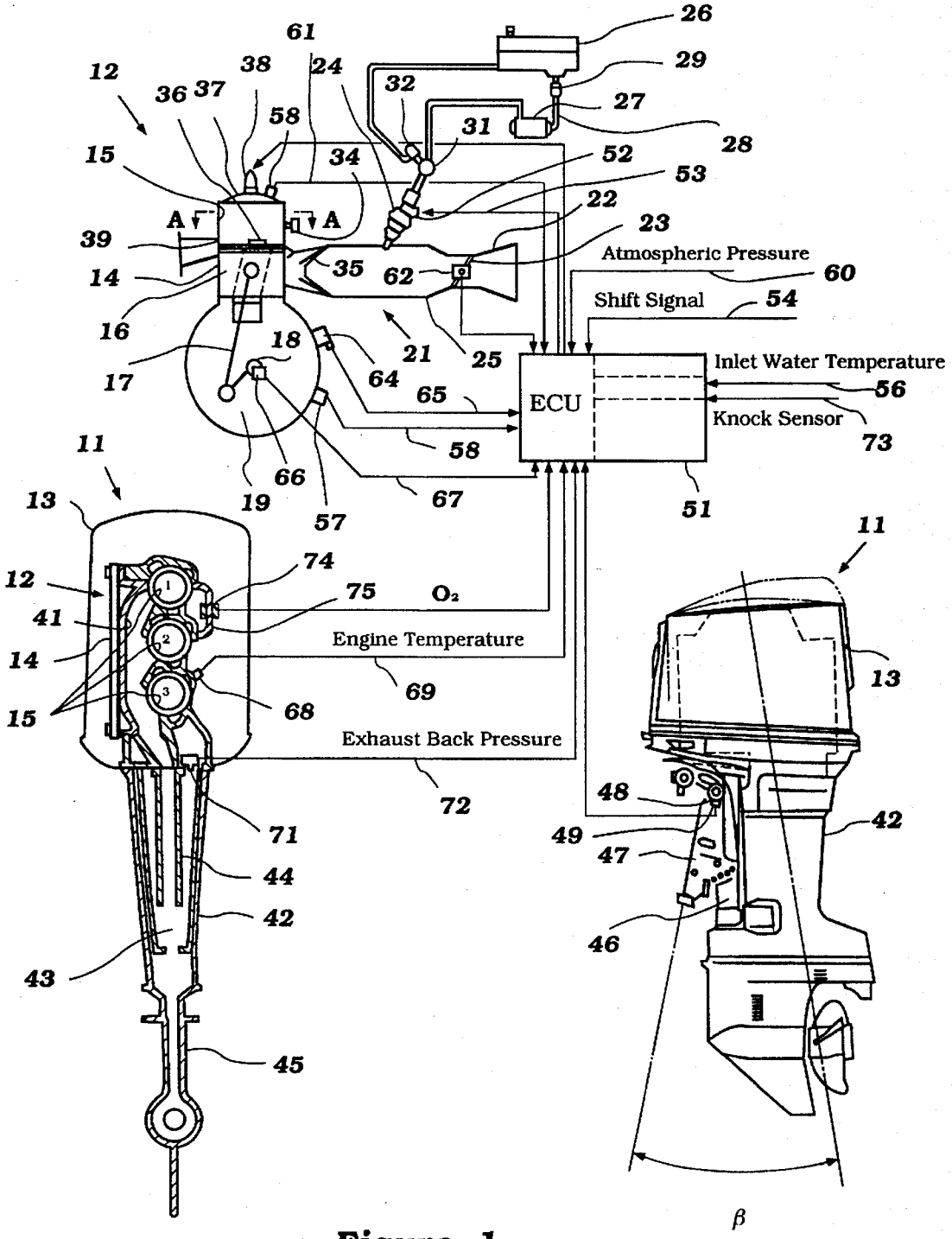
FIG. 1 is a partially schematic view of an outboard motor constructed and operated in accordance with an embodiment of the invention, with the outboard motor being shown in side elevation, in a vertical cross section, and schematically in a horizontal cross section so as to show the interrelationship of all of the components.

Referring now in detail to the drawings and initially to FIG. 1, an outboard motor is identified generally by the reference numeral 11. This view is composite view showing the complete outboard motor 11 in side elevation in a fully trimmed down position, in a vertical cross section about a plane perpendicular to the side elevation and schematically with a single cylinder of the powering internal combustion engine shown in cross section. The engine is identified generally by the reference numeral 12 and the associated fuel injection system for it shown partially in cross section and partially schematically.

The invention is described in conjunction with an outboard motor only as a typical environment in which the invention may be practiced. The invention has particular utility with two cycle crankcase compression internal combustion engines and since such engines are frequently employed as the power plants for outboard motors, an outboard motor is a typical environment in which the invention may be employed. The invention also has particular utility in conjunction with the use of engines for powering watercraft and particularly those wherein at least a portion of the exhaust gases are delivered through an underwater exhaust gas discharge. This type of exhaust system is utilized with either outboard motors or with the stern drive portion of inboard/outboard drives.

The outboard motor 11, as already noted, includes a powering internal combustion engine 12 which, in the illustrated embodiment, is comprised of a three cylinder in-line engine. It will be readily apparent to those skilled in the art how the invention can be employed in conjunction with engines of other configurations.

The engine 12 forms a portion of the power head of the outboard motor and this power head is completed by a protective cowling 13 which surrounds the engine 12 in a known manner. As may be seen in the lower left hand view of this figure, the engine 12 is comprised of a cylinder block 14 in which three aligned cylinder bores 15 are formed. Pistons 16 reciprocate in the cylinder bores 15 and are connected to connecting rods 17 which, in turn, drive a crankshaft 18 in a well known manner. The crankshaft 18 is rotatably journaled within a crankcase assembly which is divided into individual chambers 19 each associated with a respective one of the cylinder bores 15 and which are sealed from each other in a manner well known in this art.

A fuel/air charge is delivered to the crankcase chambers 19 by an air induction and fuel charge forming system, indicated generally by the reference numeral 21, and which includes an atmospheric air inlet 22 in which a manually operated throttle valve 23 is positioned. Electronically operated fuel injectors 24 spray fuel into an intake manifold 25 downstream of the throttle valve 23.

The fuel injectors 24 receives fuel from a fuel system including a remotely positioned fuel tank 26. Fuel is drawn from the fuel tank 26 by means of a high pressure fuel pump 27, through a conduit 28 in which a filter 29 is positioned. This fuel then delivered to a fuel rail 31 in which a pressure regulator 32 is provided. The pressure regulator 32 maintains the desired pressure in the fuel rail by bypassing excess fuel back to the fuel tank 26 through a return conduit 33. The operation of the fuel injectors 24 will be described in more detail later.

The intake manifold 25 delivers air to the intake ports 34 of the engine through reed type check valves 35 which operate to preclude reverse flow. The inducted charge is drawn into the crankcase chambers 19 upon upward movement of the pistons 16 and then is compressed upon downward movement. The compressed charge is then transferred to the area above the pistons 16 through a plurality of scavenge passages 36 in a manner well known in this art.

A cylinder head 37 is affixed to the cylinder block 14 in a known manner and defines a recess which forms part of the combustion chamber. A spark plug 38 is mounted in each cylinder recess and is fired by the ignition system in a known manner.

The cylinder block 14 is formed with an exhaust port 39 for each cylinder which communicates with an exhaust manifold 41 formed in part in the cylinder block 14.

As is typical with outboard motor practice, the cylinder block 14 and cylinder head 37 are formed with cooling jackets through which coolant is circulated from the body of water in which the outboard motor 11 is operating in any conventional manner.

A drive shaft housing 42 depends from the power head and rotatably journals a drive shaft which is driven by the engine crankshaft 18 in a known manner. The drive shaft housing 42 is formed with an internal expansion chamber 43 to which exhaust gases are delivered from the exhaust manifold 41 by an exhaust pipe 44. Any suitable internal baffling and cooling system is provided for the exhaust gases and they are then discharged through a conventional underwater high speed exhaust gas discharge, which may comprise an outlet formed in the lower unit 45 or in the hub of a propeller driven by the drive shaft. In addition, an above the water, low speed gas discharge may be incorporated.

As is typical with outboard motor practice, a steering shaft (not shown) is connected to the driveshaft housing 42 in a known manner. This steering shaft is journaled for steering movement about a generally vertically extending steering axis within a swivel bracket 46. The swivel bracket 46 is, in turn, pivotally connected to a clamping bracket 47 for tilt and trim movement about a horizontally disposed axis by a pivot pin 48. The lower right hand side view of FIG. 1 shows the outboard motor 11 in a fully trimmed down position where it is disposed at the angle β to the transom of the associated watercraft. The trim may be adjusted in any known manner.

As will be noted hereinafter, this trim adjustment may be effected automatically to a position at which the watercraft speed is optimized for a given engine speed. The invention also may be used with other types of automatic trim control systems.

In addition, the pivotal connection 48 permits the outboard motor 11 to be tilted up out of the water when not in use. For control purposes, as will be described, a trim position indicator 49 is mounted to cooperate between the clamping bracket 47 and swivel bracket 46 to provide an output signal to an ECU, indicated generally the reference numeral 51. The total control strategy will be described later.

The construction of the outboard motor 11 and its powering internal combustion engine 12 as thus far described may be considered to be conventional and all of the components which have been illustrated may be of any conventional type. Since the invention deals with the fuel injection and spark control systems for the engine and their control, it is believed unnecessary to describe in further detail the components of the engine which may be considered to be conventional.

Referring now in more detail to the fuel injection system and the control therefor, as previously noted, the fuel injectors 24 are electronically controlled. To this end, each injector 24 is provided with an electrical terminal 52 that receives an output control signal from the ECU, through a conductor indicated the line 53. A solenoid of the fuel injectors 24 is energized when the ECU 51 outputs a signal to the terminal 51 through the line 53 to open an injection valve and initiate injection. Once this signal is terminated, injection will also be terminated. The injectors 24 may be of any known type and in addition to a pure fuel injectors may comprise an air/fuel injectors.

A number of ambient atmospheric conditions are supplied to the ECU 51 and certain engine running conditions are supplied to the ECU 51 so as to determine the amount of fuel injected and the timing of the fuel injection. These ambient conditions may comprise atmospheric pressure which is measured in any suitable manner by a sensor and which signal is transmitted to the ECU 51 through a conductor 60, temperature of the intake cooling water which is delivered to the engine cooling jacket from the body of water in which the watercraft is operating as sensed by an appropriate sensor (not shown) and transmitted through to the ECU 51 through a conductor 56, and the intake air temperature is sensed in the crankcase chamber 19 by a temperature sensor 57 which outputs its signal to the ECU 51 through a conductor 58. Additional ambient conditions may be measured and employed so as to provide more accurate control of the fuel injection, if desired.

There are also provided a number of engine condition sensors which sense the following engine conditions. An in-cylinder pressure sensor 59 senses the pressure within the cylinder and outputs this signal to the ECU 51 through a conductor 61. A throttle valve position sensor 62 senses the position of the throttle valve 23 and outputs this signal to the ECU 51 through a conductor 63. Crankcase pressure is sensed by a pressure sensor 64 which is also mounted in the crankcase chamber 19 and outputs its signal to the ECU 52 through a conductor 65. Crank angle position indicative of the angular position and rotating speed of the crankshaft 18 is determined by a sensor 66 and output to the ECU 51 through a conductor 67.

Engine temperature is sensed by a sensor 68 mounted in the cylinder block 14 and inputted to the ECU 51 through a conductor 69. Exhaust system back pressure in the expansion chamber 43 is sensed by a sensor 71 and is outputted to the ECU 54 through a conductor 72. Finally, a knock sensor (not shown) output a signal to the ECU 51 when a knocking condition is sensed through the conductor 73. As with the ambient conditions, additional engine running conditions may be sensed. Those skilled in the art can readily determine how such other ambient or running conditions can be sensed and fed to the ECU 51 and processed by the ECU 51 to determine the fuel injection supply both in timing and amount.

As is disclosed in U.S. Pat. No. 4,461,260 entitled "Fuel Injection System For Two-Cycle Internal Combustion Engines," issued Jul. 24, 1984, the airflow to the engine can be accurately measured by the crankcase pressure sensor 64 when the pressure reading is taken at a specific crankshaft angle as set forth therein. However, as will be discussed below, it has been discovered that the back pressure in the exhaust system as sensed by the sensor 71 will effect the accuracy of the crankcase pressure in indicating air flow. As will be described later, a correction is made for this condition as well as trim angle condition as sensed by the sensor 49.

A transmission condition sensor (Not Shown) for the transmission in the lower unit also sends a transmission position (F, N or R) to the ECU 51 through a conductor 54.

Finally, the engine control and particularly the air fuel ratio is controlled by controlling the timing of the beginning of injection by the fuel injectors 24 and the duration of injection through a feedback control system. This system includes an oxygen sensor 74 that is placed in a bypass passage 75 that interconnects the exhaust passages from two adjacent cylinders and is located in a location wherein it will be least effected by exhaust system back pressure.

The ECU 51 is programmed to provide a feedback control system based upon the output of the oxygen sensor 74 and any other engine factors in a conventional manner. However, in accordance with an important feature of the invention, this feedback control is modified based upon certain factors which will tend to cause the output from the oxygen sensor 74 not to be truly indicative of the actual conditions that determine the appropriate air fuel ratio. Generally the system is designed to maintain a stoichiometric mixture where actual air fuel ratio divided by stoichiometric is equal to 1 ($\lambda=1$), but it has been found that the desirable feedback control of the fuel mixture and the spark advance are also effected by actual exhaust system back pressure as sensed by the sensor 71.

In addition to the engine and atmospheric conditions sensed there may be other sensors associated with the hull or watercraft powered by the outboard motor 11. One such watercraft sensor is the trim sensor 49. If the outboard motor also is mounted by means that includes a lift adjustment, then a lift position sensor may also be incorporated to provide a lift signal to the ECU 51. The throttle actuator (not shown) or the throttle valve sensor 62 may also be coupled to a timer in the ECU 51 to provide a signal of rate of change (acceleration) called for by the operator.

Figure 2:
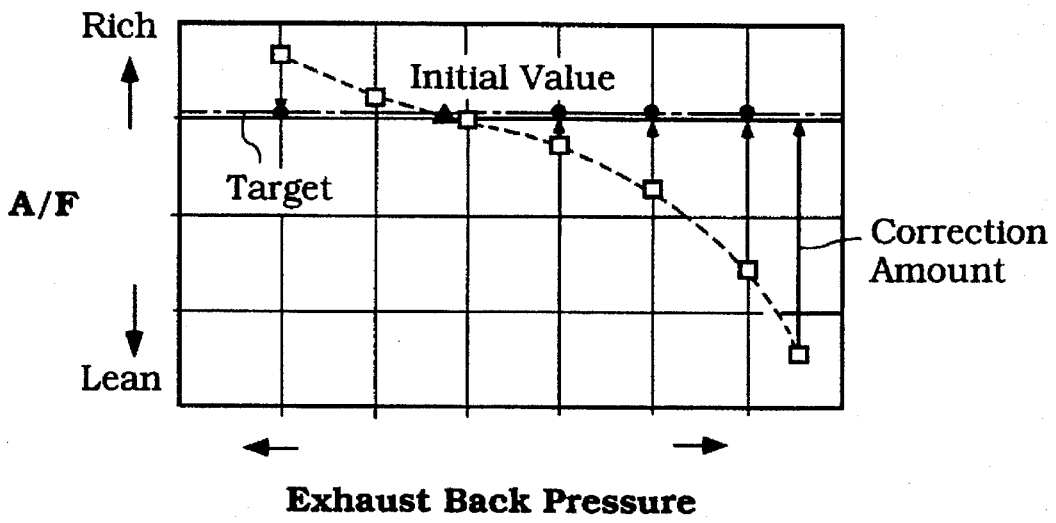
FIG. 2 is a graph showing the air-fuel ratio corrections relative to exhaust gas back pressure, with the target air-fuel ratio being shown by the broken line and the corrective amount required indicated.

The effect of changes in exhaust back pressure may be understood by reference to FIG. 2, which is a graphical view showing air fuel ratio in relation to exhaust back pressure. Shown on this graph is standard of initial value at idle condition. It will be seen that if the exhaust gas pressure falls below normal, the exhaust gases can flow more freely and the air flow into the cylinder will be greater so that the mixture tends to become lean. Therefore, if the exhaust back pressure falls below the initial value, then the system should add to the fuel supplied so as to compensate for its leanness.

On the other hand, if the back pressure raises, then the flow of exhaust gases is retarded and the air intake amount is decreased and the mixture tends to become rich. Therefore, the system leans the fuel from what would normally be provided under this condition in order to maintain stoichiometric conditions. It should be noted that in this description it is assumed that the desired air fuel ratio is stoichiometric. However, where this term is used, it is to understood that it could equally be the desired air fuel ratio which might be on the lean or rich side, depending upon the particular engine design.

Figure 3:
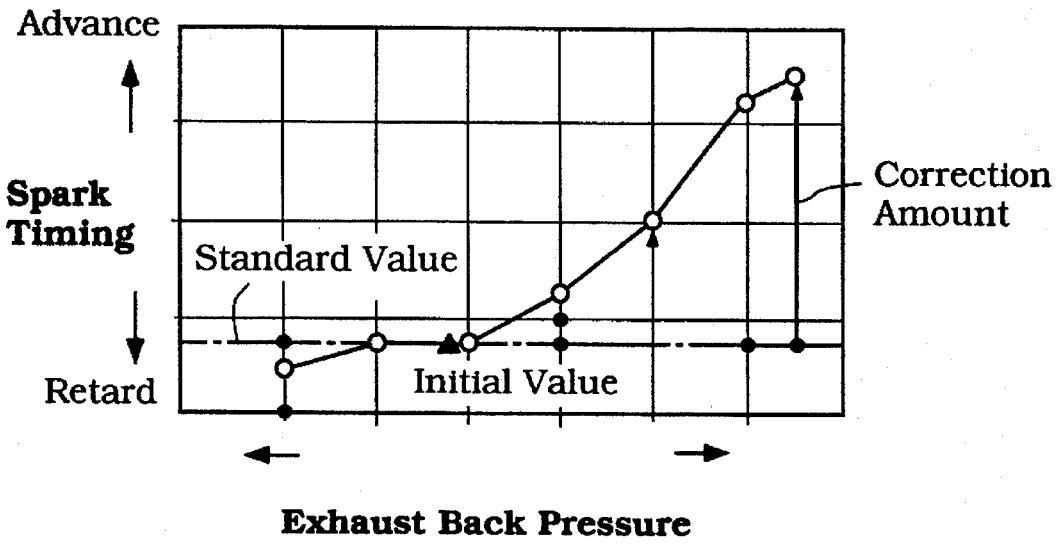
FIG. 3 is a graphical view showing the spark timing correction in response to exhaust gas pressure, with the standard initial value and the corrective amounts to accommodate back pressure being shown.

In a similar manner and as shown in FIG. 3, the ideal spark timing also is dependent upon exhaust back pressure. If the pressure falls below the normal or designed value, then the spark should be retarded because flame will tend to propagate faster and this is done so as to avoid the peak pressure occurring at the incorrect time. On the other hand, if back pressure rises, then the flame will propagate slower and the spark should be advanced.

Figure 4:
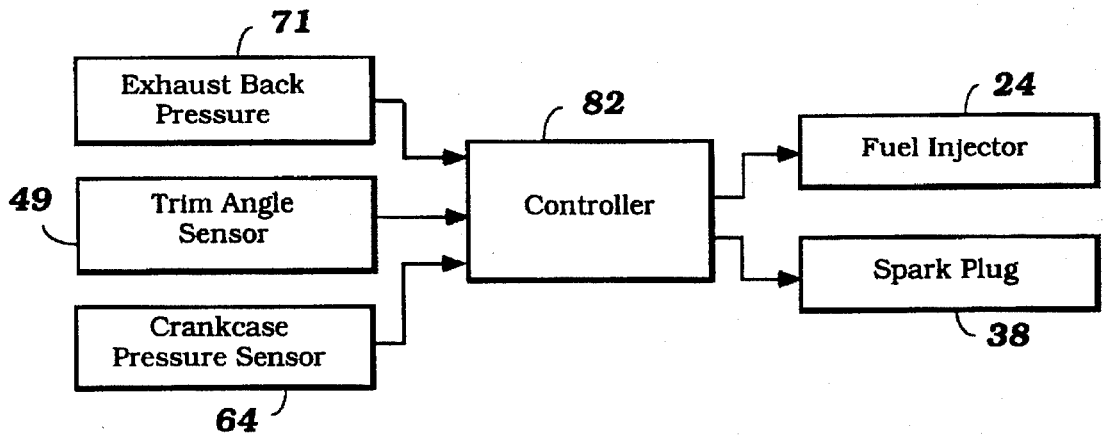
FIG. 4 is a block diagram showing the relationship of the back pressure, trim angle, and crankcase pressure sensors to the controller and how the fuel injection and spark timing are controlled in response to these signals.
Figure 5:
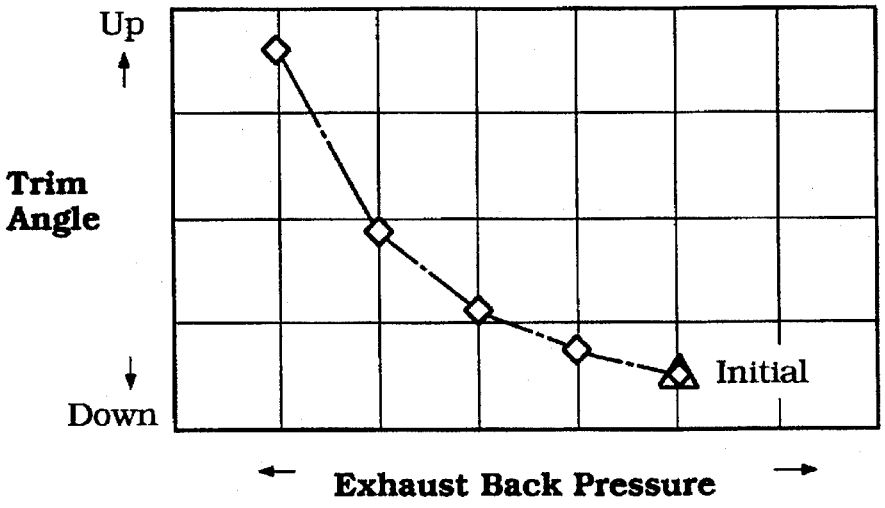
FIG. 5 is a graphical view showing the relationship of trim angle to exhaust gas back pressure.

FIG. 4 shows schematically the relationship of the exhaust back pressure sensor 71, the trim angle sensor 49 and the crankcase pressure sensor 64 with the controller 82 of the ECU 51. The controller output signals to the fuel injector 24 for controlling the timing and duration of fuel injection and also to the ignition system for firing the spark plugs 38 so as to control their spark timing. Not shown in FIG. 4 but also included is the output of the oxygen sensor which provides the combustion condition signals also to the controller so as to maintain the desired fuel air ratio, modified as will be described in conjunction with the following information.

It should be understood that the basic fuel control feedback strategy utilizing the oxygen sensor may be as described in the aforenoted copending application Ser. No. 08/402,193, the disclosure of which is incorporated hereinby reference. This disclosure will deal primarily with the way in which the basic strategy is adjusted so as to compensate for various changes, primarily in watercraft operating conditions such as trim, speed, acceleration, transmission condition, etc.

In addition to the depth at which the exhaust is discharged and the speed of travel of the watercraft or its operational mode affecting the ideal air fuel ratio, the trim adjustment also has been found to affect these conditions. When fully trimmed down, the exhaust back pressure is at its highest and the back pressure decreases, but not linearly as the drive is trimmed up.

Changing the trim not only changes the height of the exhaust outlet, but also its angle to the water. When fully trimmed down, the exhaust gases are directed totally at the water and have no significant component directed toward the air above the water. However, as the outboard drive is trimmed up, then the exhaust gas outlet through the hub propeller discharge begins to face upwardly and the exhaust gases can exit more easily because they need travel less distance to reach the atmosphere, and hence the back pressure will decrease.

Thus, it is also possible to employ a section, shown at the block 82 of the ECU 51, that receives not only exhaust back pressure signal from the sensor 71 and crankcase pressure from the sensor 64, but also the output of the trim sensor 49 so as to adjust not only the fuel injector 24 but also the timing of firing of the spark plugs 38.

Figure 6:
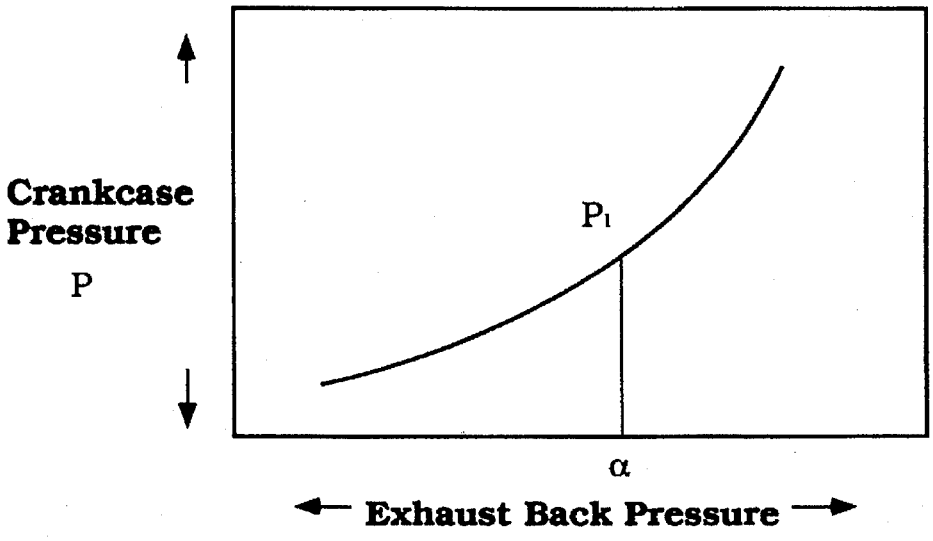
FIG. 6 is a graphical view showing how crankcase pressure varies as exhaust gas back pressure varies.
Figure 7:
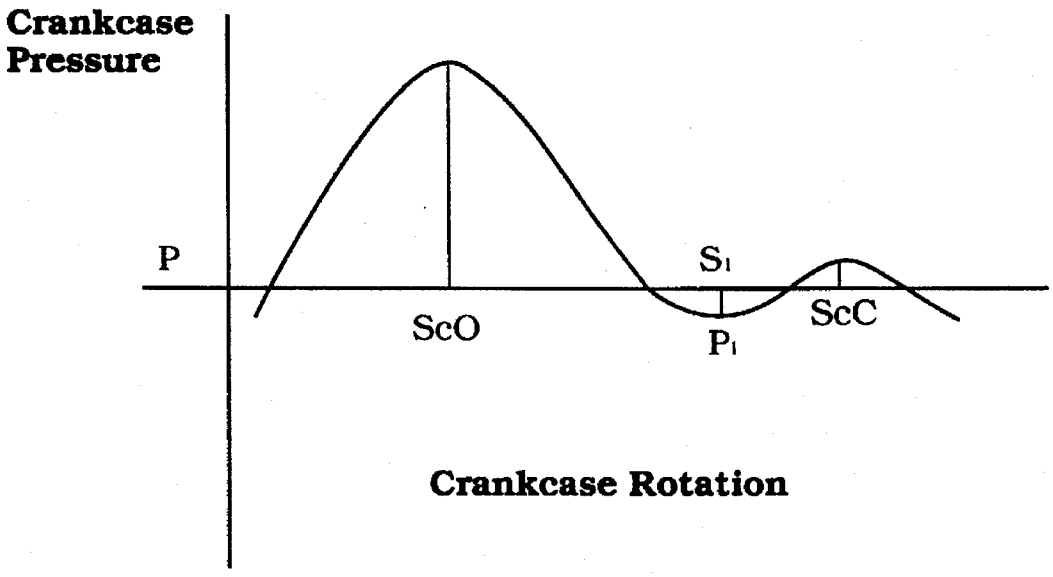
FIG. 7 is a graphical view showing how crankcase pressure varies during a portion of the rotation of the crankshaft.

FIG. 6 is a graphical view that show how the exhaust back pressure effects the crankcase pressure if all other things are constant. FIG. 7 is a graphical view that shows how the crankcase pressure varies during a cycle of operation reaching its maximum at the time when the scavenge port opens and falls to a minimum intermediate value at the time S1 and P1 before the scavenge port closes. It is this value P1 that is measured in accordance with the aforenoted method described in U.S. Pat. No. 4,461,260 that is employed to measure airflow.

As noted, FIG. 6 shows how the value of P1 varies with exhaust gas back pressure. If the back pressure is lower than normal, indicated by the point $\alpha$, the crankcase pressure will be lower while as the exhaust back pressure increases the crankcase pressure will increase. Again, these functions are not linear. This is another reason why exhaust back pressure must be taken into account to obtain ideal feedback control because the airflow calculation which is based on the crankcase pressure will also vary dependent upon exhaust back pressure.

The exhaust gas back pressure also is related to watercraft speed. That is, with a through the propeller exhaust gas discharge the exhaust gasses tend to be discharged into a low pressure area with the low pressure being reduced as the speed of the watercraft increases. However, the exhaust gas back pressure also increases because of engine speed increase as the boat speed increases and FIGS. 8 and 9 show how the exhaust gas back pressure varies with boat speed and how the amount of fuel injected must be adjusted in response to these same watercraft conditions.

Figure 8:
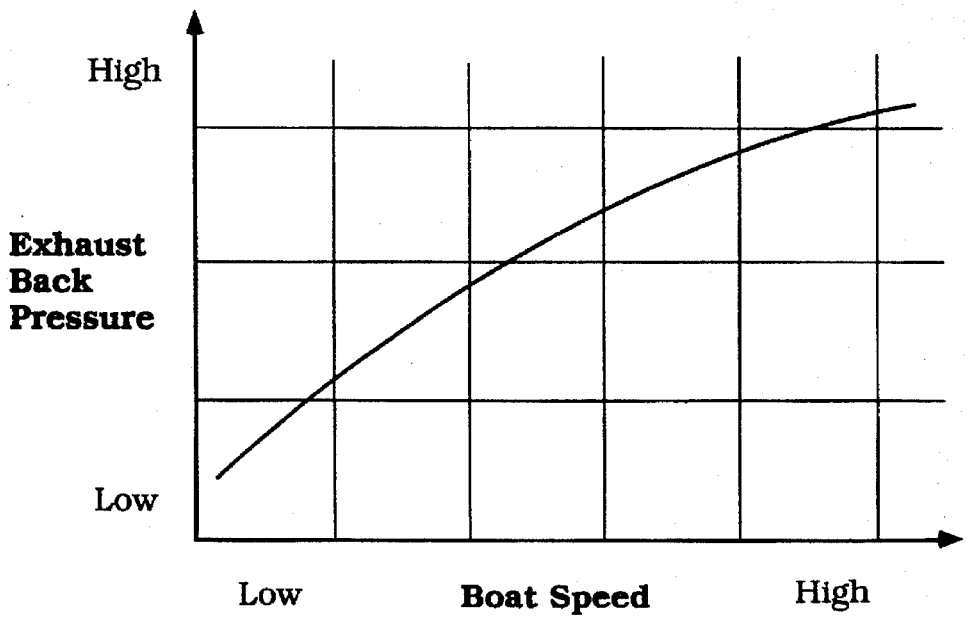
FIG. 8 is a graphical view showing how the exhaust back pressure varies with watercraft speed.
Figure 9:
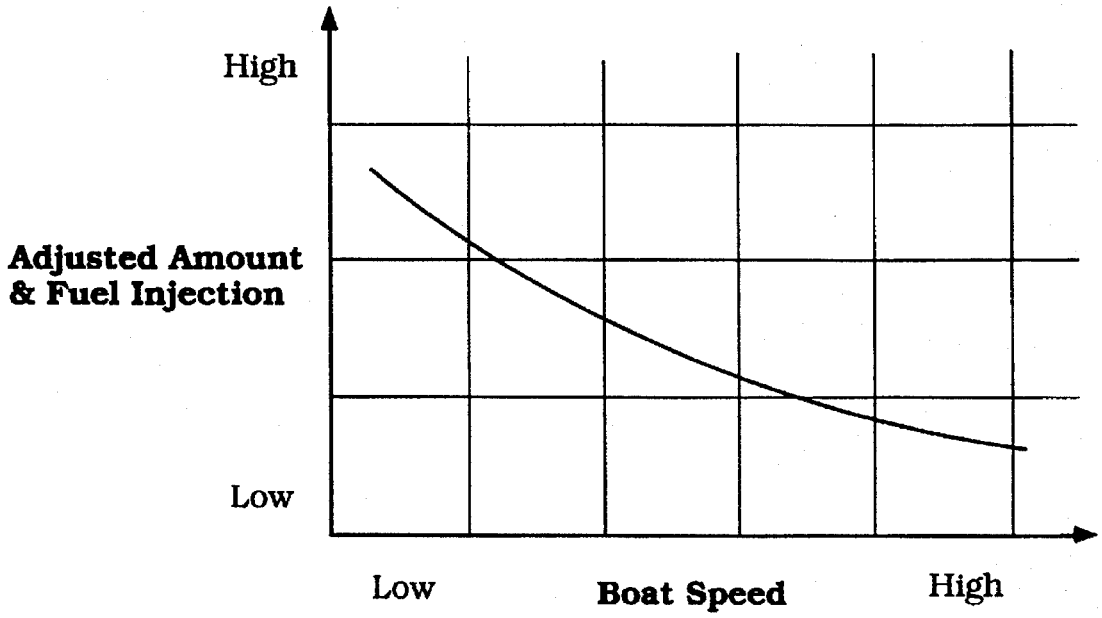
FIG. 9 is a graphical view showing how the adjusted amount of fuel varies in response to watercraft speed to compensate for these back pressure conditions.

As may be seen from FIG. 8, as the boat speed increases the exhaust back pressure actually increases but not at a linear rate. The pressure increases more rapidly at first and then the rate of increase falls off. This is because the exhaust gas back pressure increases more rapidly on a change in speed than the actual boat speed. Thus, these changes in exhaust gas back pressure are compensated for by having the ECU take the watercraft speed signal and generate an adjustment curve in the amount of fuel injection as shown in FIG. 9 in relation to the boat speed.

Since the exhaust gas back pressure increases the amount of additional fuel required decreases. Again, however, the relationship is not linear and there must be a higher amount of fuel injection correction at low speed conditions and a lower amount of correction in injection amount at high speed conditions for the watercraft.

Figure 10:
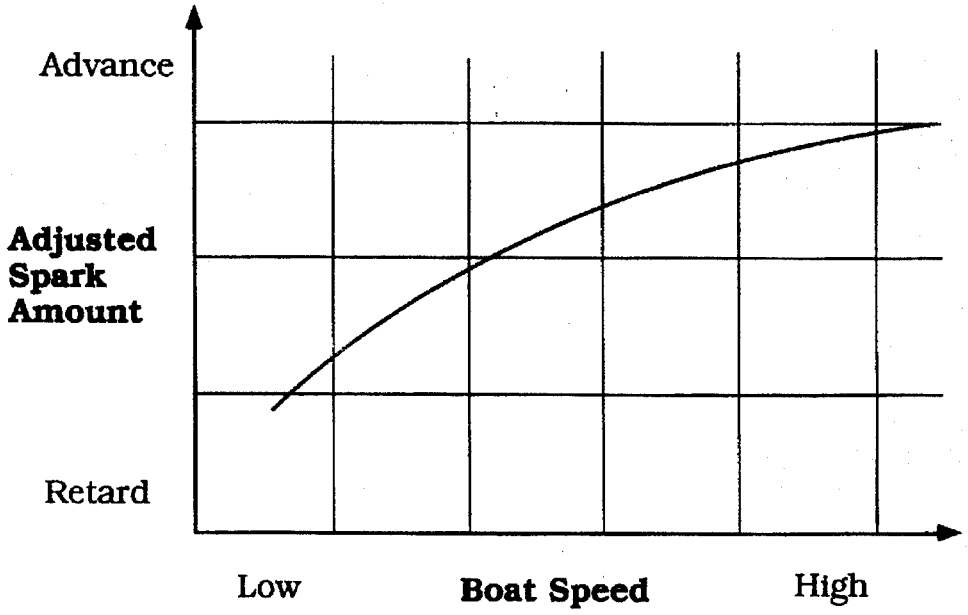
FIG. 10 is a graphical view showing how the spark advance is adjusted in response to engine speed to compensate for these back pressure variations.

Like the other factors, boat speed also affects the optimum spark advance timing and FIG. 10 shows a curve that shows the adjustment in spark advance amount required due to variations in boat speed. Again, as the boat speed goes up the amount of spark advance increases but again at a nonlinear rate. Therefore, the ECU also adjusts the spark advance in a curve generated like the map of FIG. 10 in response to sensed watercraft or hull speed.

Figure 11:
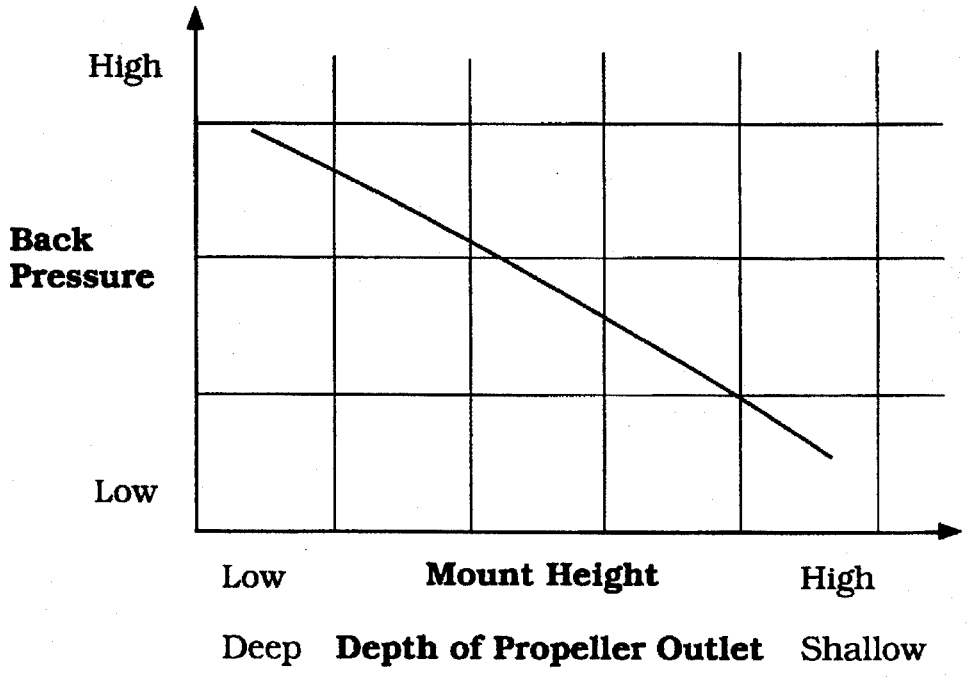
FIG. 11 is a graphical view showing how the height of mounting of the propulsion unit on the transom affects the back pressure.
Figure 12:
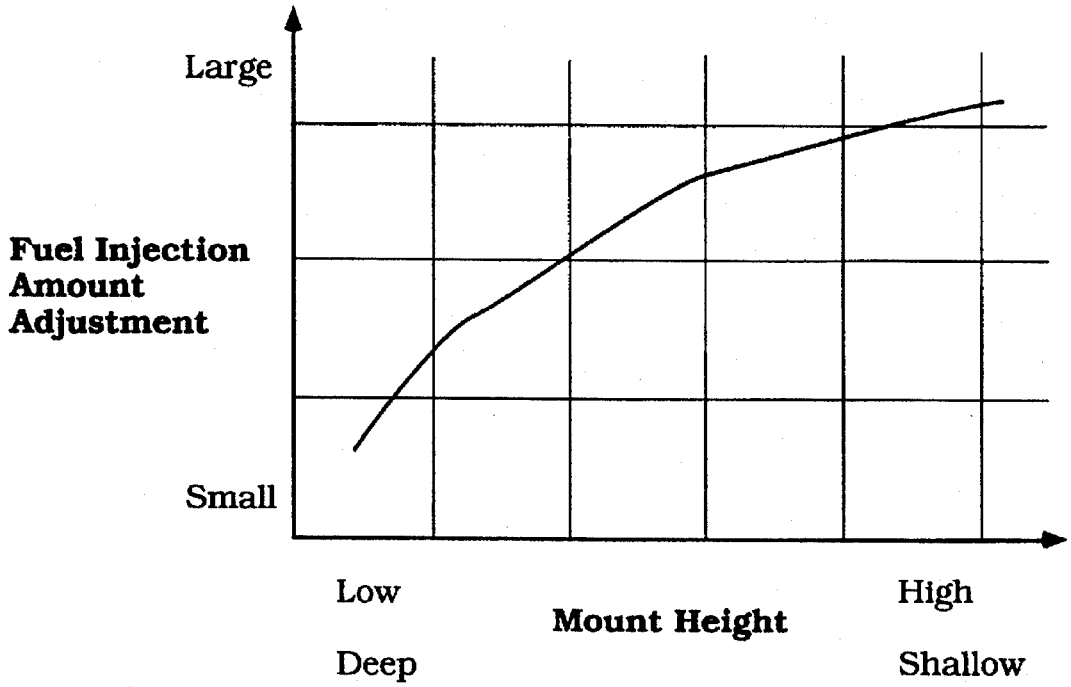
FIG. 12 is a graphical view showing how the height of mounting effects the desired degree of fuel injection amount and the adjustment factor therefor to compensate for the difference in height.
Figure 13:
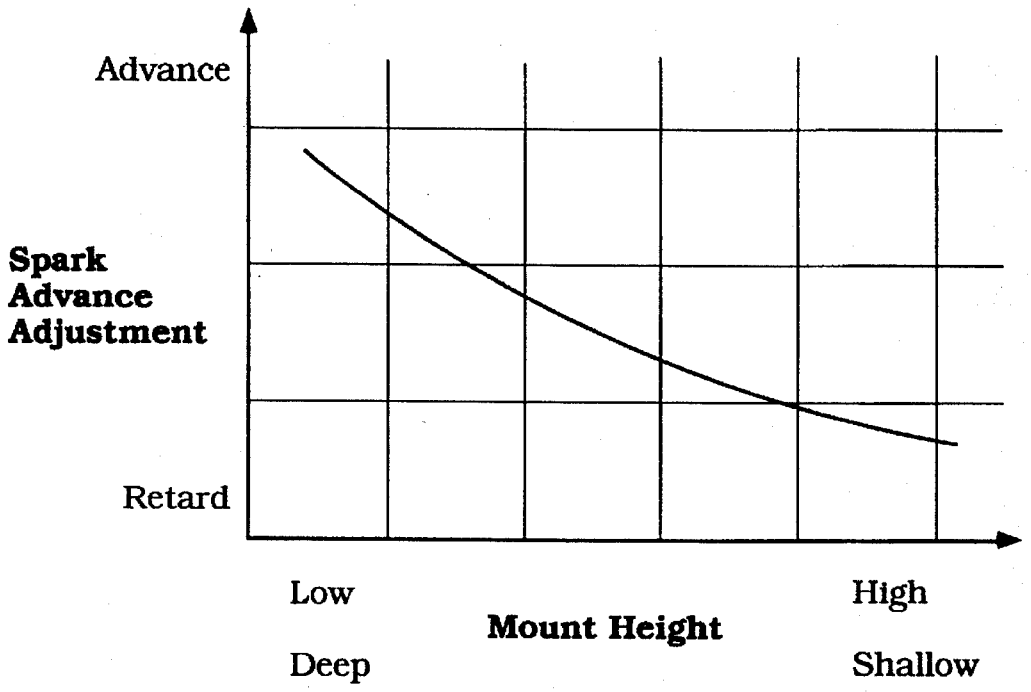
FIG. 13 is a graphical view showing how the spark advance is adjusted with varying heights to compensate for the back pressure changes.

As has been noted, in addition to providing a trim adjustment for the trim of the propeller of the outboard motor, the outboard motor 11 may also be provided with an automatic lift mechanism. FIGS. 11 through 13 show the effect of changes in lift height on back pressure, fuel injection amount adjustment and spark advance adjustment, respectively.

As may be best seen in FIG. 11, the vertical height adjustment unlike trim adjustment provides a relatively linear change in exhaust back pressure. This is because the movement is purely vertically and not through the angle wherein the angle of attack of the discharge of the exhaust gases into the water also varies. Hence, the back pressure decreases in a generally linear fashion as the height is increased. Again, however, this requires a nonlinear adjustment in the fuel injection amount with the amount of additional fuel injected being elevated as the height of the propeller discharge increases (lower penetration) to compensate for the better exhaust from the combustion chambers. In a similar manner, the spark advance can be retarded as the height is increased.

The factors of boat speed mount height and back pressure also affect another engine or watercraft transient condition, this being the condition when the watercraft is accelerating. As is well known with internal combustion engines, the airflow to the engine increases more rapidly than does the fuel flow. Therefore, it has been the practice both with carburetors and fuel injectors so as to inject or supply additional amounts of fuel during the initial acceleration phases.

Figure 16:
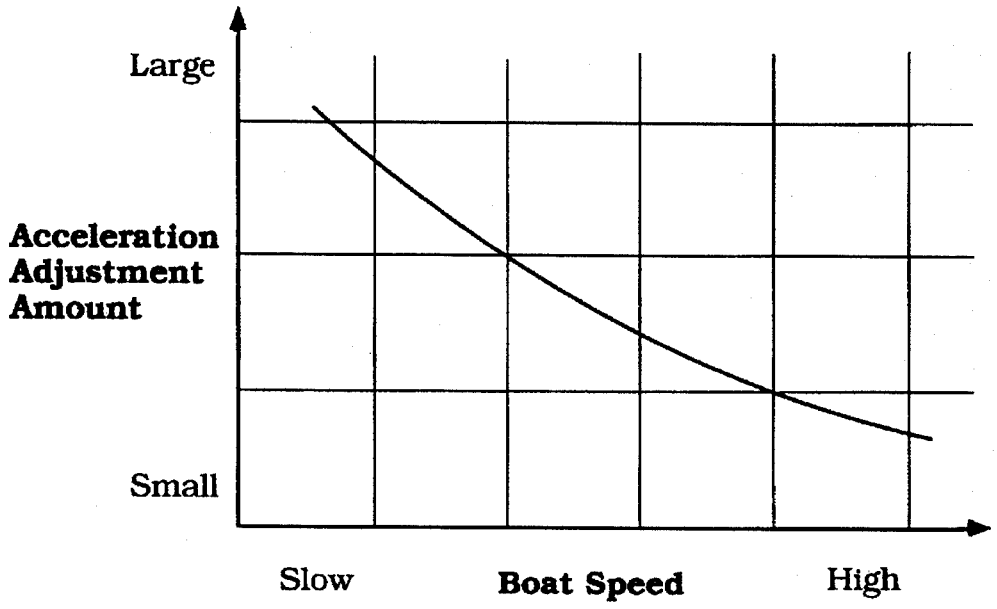
FIG. 16 is a graphical view showing how the amount of fuel should be varied during acceleration for various watercraft hull speeds.

FIG. 16 shows how the actual boat speed at the time of acceleration requires a varying amount of acceleration adjustment fuel amount. When the boat speed is low and there is acceleration, there must be a larger acceleration amount of fuel supplied than when the boat speed is higher. This is primarily a result of the fact that the engine speed and air flow may increase more rapidly when accelerating from lower speeds than higher speeds.

In a similar manner, as the mount height changes, the engine will tend to accelerate faster and thus the amount of acceleration adjustment in fuel supply is increased in an almost linear fashion as the height of the propeller is increased or its depth of submersion decreased.

Figure 14:
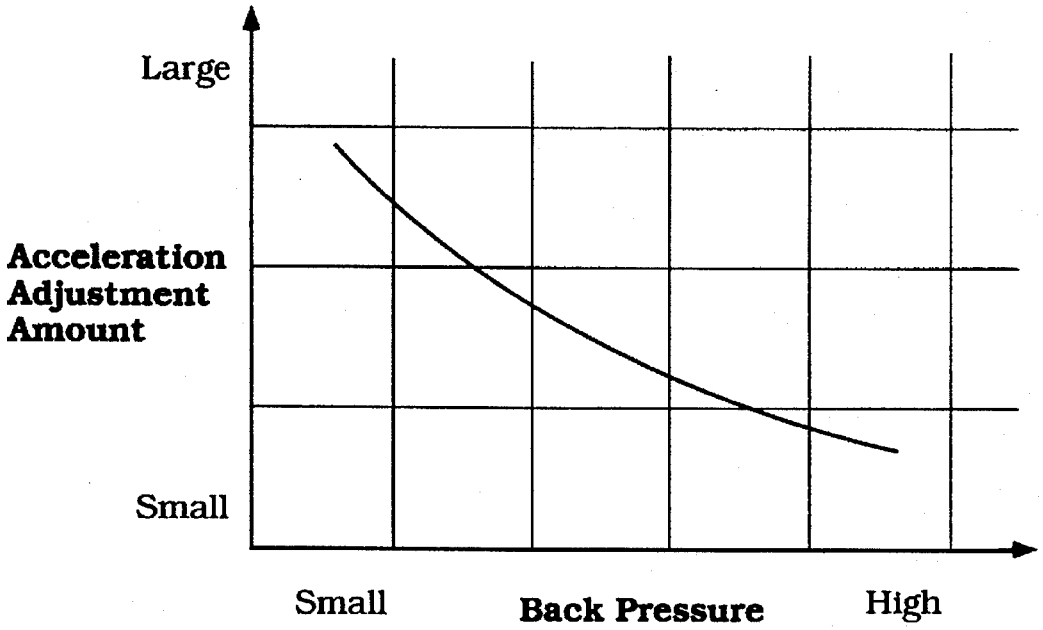
FIG. 14 is a graphical view showing how the back pressure effects the acceleration amount of fuel to be added during acceleration.
Figure 15:
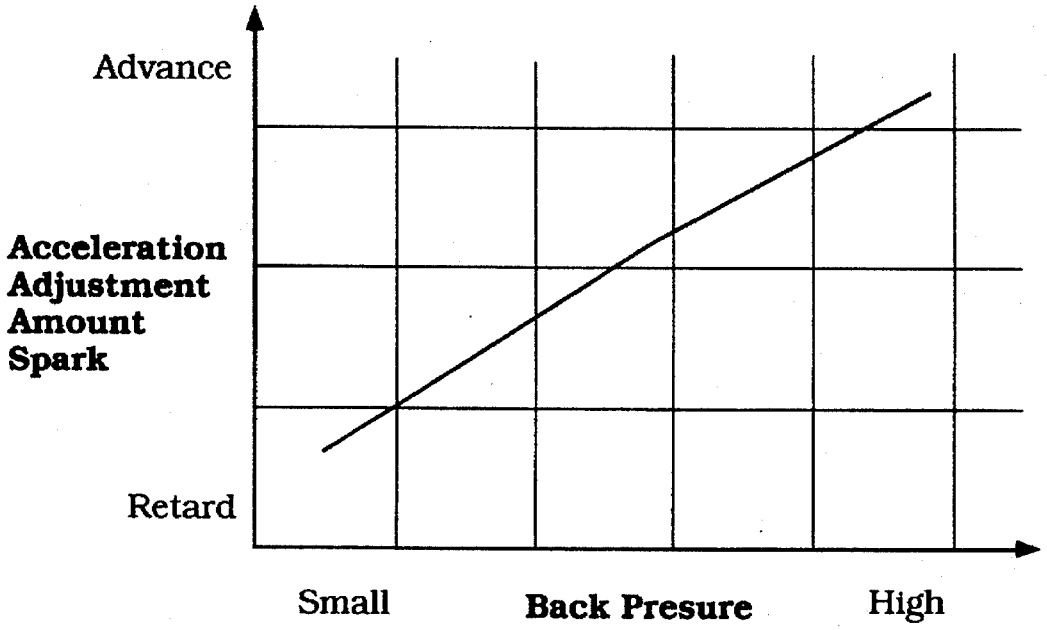
FIG. 15 is a graphical view showing how the spark adjustment should be changed with respect to variations in back pressure during acceleration to compensate for the changes in back pressure.

Also, the acceleration adjustment amount varies with back pressure and, for the reasons already described, the spark advance should also be varied under these conditions. FIGS. 14 and 15 are graphical views showing the adjustment amount of fuel as back pressure increases and the amount of spark advance that is changed as back pressure increases under acceleration conditions.

Figure 17:
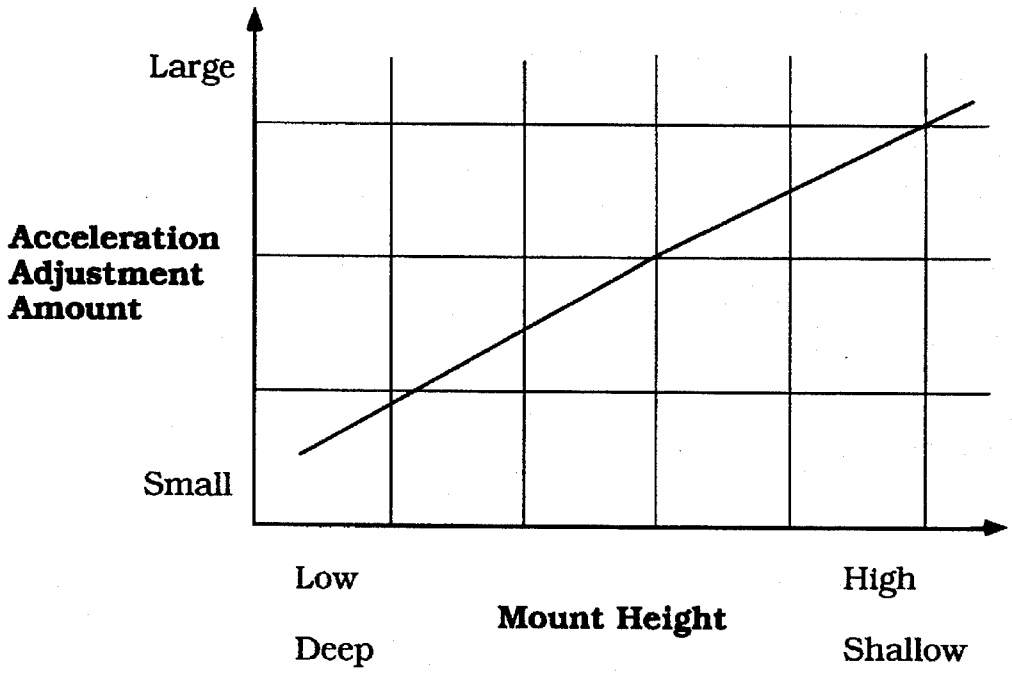
FIG. 17 is a graphical view showing how the amount of fuel injection enrichment should be varied depending upon the mounting height under acceleration.

From the foregoing description it should also be apparent that such factors as speed of the watercraft and height of the propulsion device exhaust discharge outlet also will vary the amount of fuel required under acceleration conditions. FIGS. 16 and 17 show graphical views of the acceleration fuel adjustment amount required as the boat speed and mount height vary.

With respect to boat speed, it will be seen that as the boat speed increases, like the effect on exhaust gas back pressure, the amount of acceleration fuel to be added varies but not linearly.

On the other hand, the mounting height acceleration adjustment is a more linear function with the lower depth in the water the smaller amount of acceleration adjustment fuel amount required due to the fact that the back pressure is higher.

As has been noted, the watercraft also may be provided with an automatic trim adjusting system. These trim adjusting systems operate so as to provide a fully trimmed down or trimmed in condition when the watercraft initially begins to move. As the watercraft begins to accelerate, the trim is adjusted in a trim out or trim up direction and at planing conditions the trim automatically adjusts to maintain the maximum hull speed for a given engine speed. However and from the foregoing description it should be readily apparent that the engine can accelerate at a different rate than the actual acceleration of the boat will occur and it has been found that by maintaining the trim in or trim down condition fixed for a predetermined time period depending upon certain factors, as will be noted, that the actual total overall performance of the watercraft can be improved.

Figure 18:
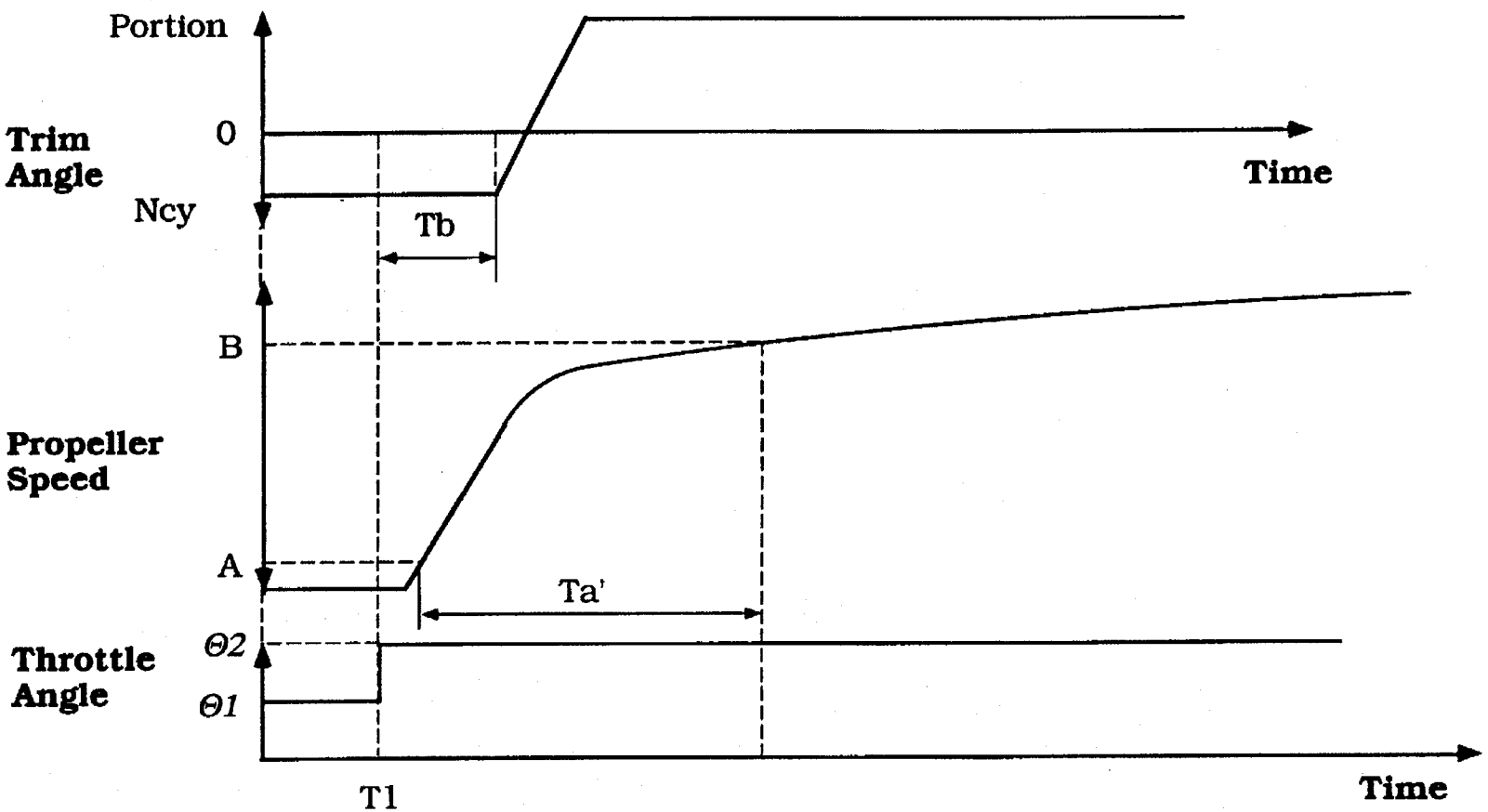
FIG. 18 is a graphical view showing how the propeller speed, trim angle and throttle valve angle vary upon acceleration of the watercraft.

That is, if the trim adjustment is deferred for an optimum time period then the motor can accelerate more rapidly and the total boat performance will be improved. This condition may be best understood by reference to FIG. 18. FIG. 18 is a graphical view showing the trim angle with respect to time at the top of the view in connection with a trim adjusting mechanism that automatically adjusts trim to maintain maximum speed. The propeller speed or actual engine speed is shown by the second curve and the position of the throttle valve is shown by the third curve.

As may be seen when operating at idle the operator at the time period T1 determines to accelerate. At this time, he opens the throttle valve from the position θ1 to the position θ2 and then holds this position. As a result, the actual speed of the propeller will not increase immediately. This time delay is shown in the middle curve or Curve B of FIG. 18. After the initial time lag for response passes then the propeller will accelerate as shown in the inclined line.

It has been found that by permitting the propeller to accelerate for a given time period Tb, as shown in FIG. 18, before the trim angle is adjusted that optimum acceleration performance of the engine and watercraft may result. Thus, the acceleration from the speed A at the time beginning shortly after when the engine actually begins to accelerate until the propeller reaches a near maximum speed TA' can be shortened and thus total boat performance can be increased. The holding time is, however, critical in obtaining this result. In accordance with a feature of the invention, the trim holding time Tb is picked to be an optimum time as may be shown in the curve of FIG. 20 so as to hold the trim before the watercraft begins its trim adjustment. This optimum time Tb is determined experimentally in accordance with a control routine as shown in FIG. 19.

Figure 19:
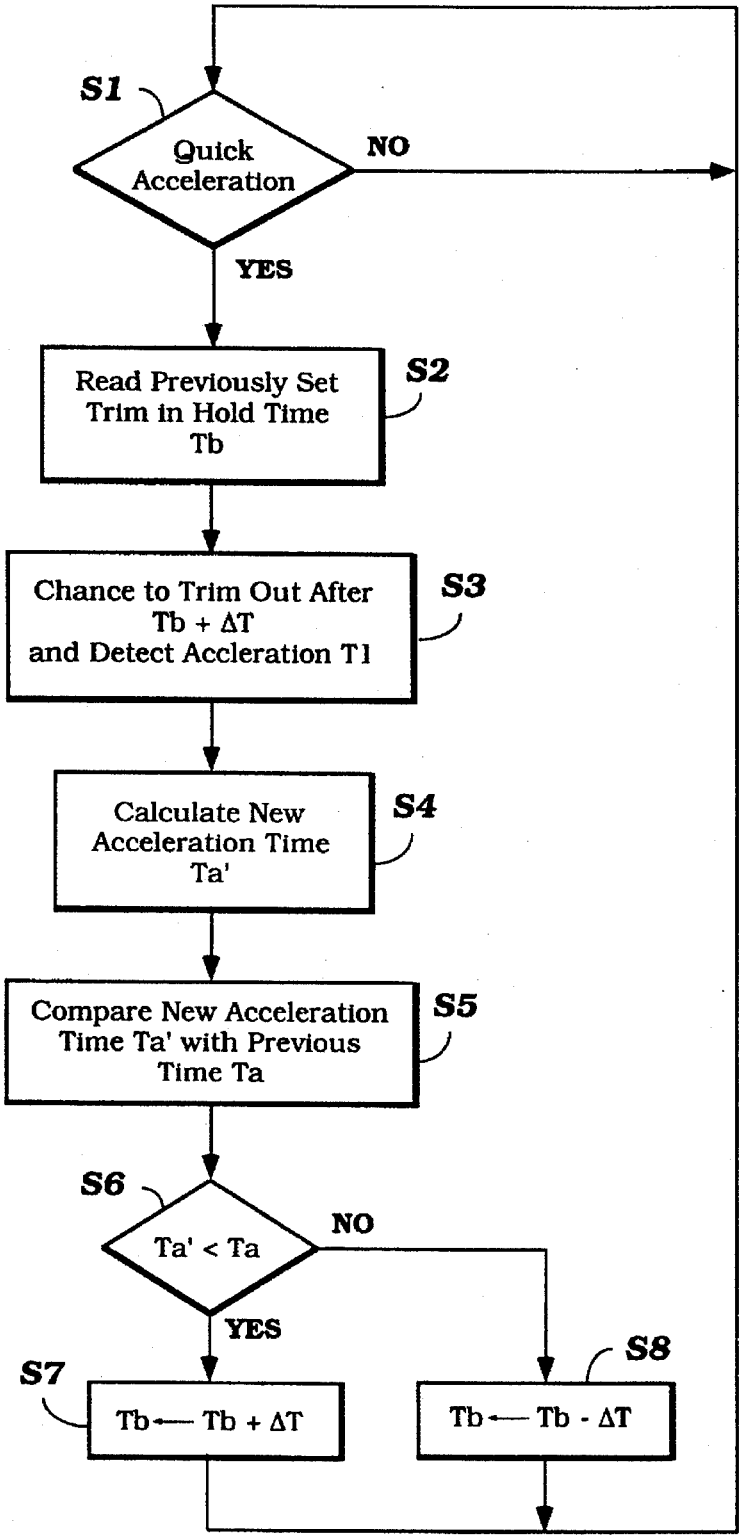
FIG. 19 is a block diagram showing the control routine to obtain optimum acceleration.
Figure 20:
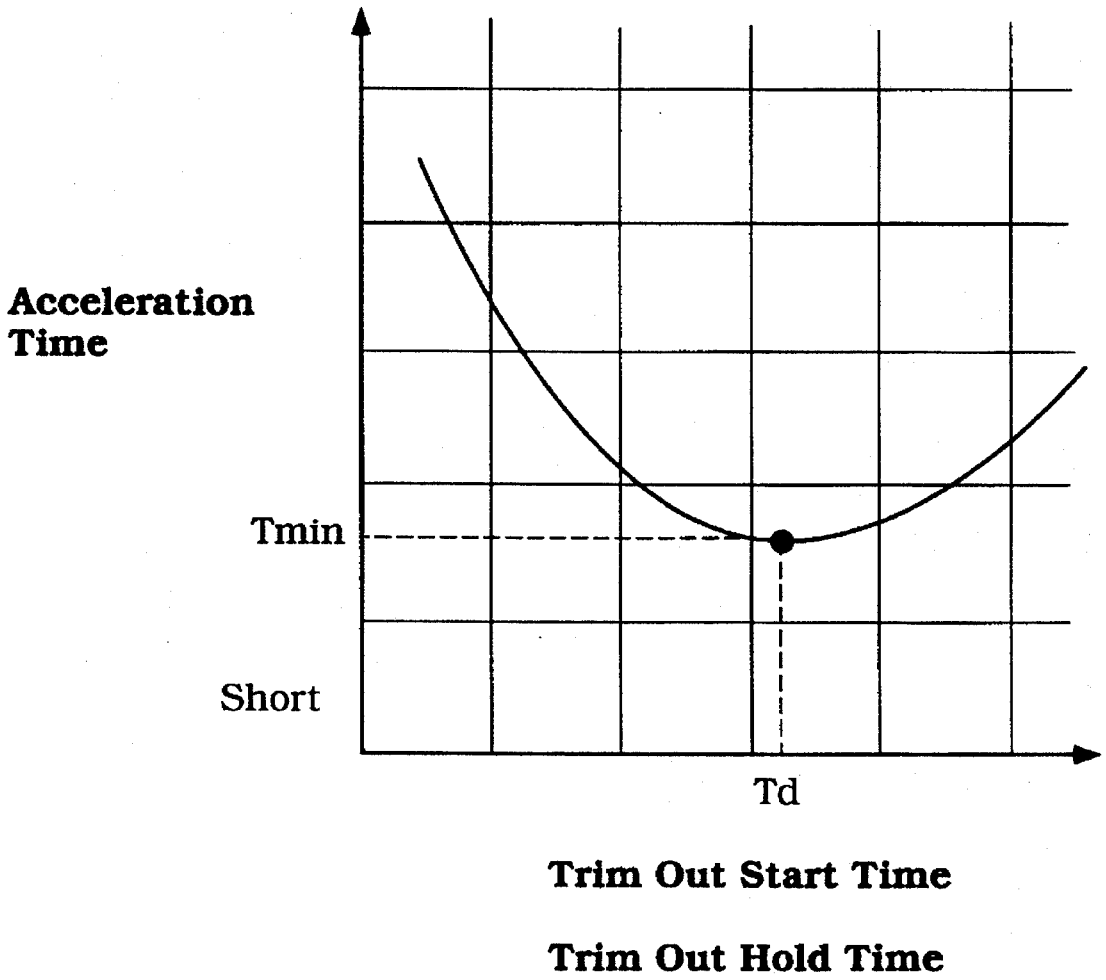
FIG. 20 is a graphical view showing the trim out start times and trim out hold times during acceleration.

FIG. 20 is a graphical view showing the acceleration time interval for the time period indicated as Ta' in FIG. 18 in relation to the time period Tb when the trim adjustment is held fixed. It will be seen that as the time T is decreased below the optimum time, shown as Td, then the acceleration time will increase. In a like manner, if the holding time is increased from the optimum time the acceleration time will also increase. Therefore, the cut and try control routine program for establishing the time Td in accordance with the control routine shown in FIG. 19 and which will now be described by reference to that figure.

In FIG. 19 the program begins at the step S1 wherein it is determined whether or not there is a quick acceleration condition being Called for. As has been previously noted, a rapid acceleration condition can be determined when the throttle position sensor indicates that the throttle valve is being opened at a predetermined degree or greater in a predetermined time or less. If the quick acceleration condition is not encountered, the program skips to the end.

If, however, the program is in a quick acceleration mode it then moves to the step S2 so as to read the trim in hold time Tb which has been previously set. The program then moves to the step S3 so as to set a new trim in hold time which is slightly longer than the previously set time dealt by summing this differential time ΔT with the previously set Tb time and the acceleration is then measured from the time period T1. The program then moves to the step S4 so as to calculate the new acceleration time Ta'.

The program then moves to the step S5 to compare this new acceleration time Ta' with the previous acceleration time Ta for the previously set trim hold time Tb. Then, at the step S6 it is determined whether Ta is less than Tb. If Ta is less than Tb then a new value for Tb is set as in accordance with the equation $Tb_{new}=Tb_{previous}+\Delta T$.

If, however, at the step S6 it is determine that the acceleration time has extended rather than decreased, the program then moves to the step S8 so as to reset the old trim hold time Tb in accordance with the following equation:

$$Tb_{new}=Tb_{previous}-\Delta t.$$

Thus by utilizing this routine in conjunction with acceleration conditions the trim control mechanism for the watercraft can be set so as to obtain optimum acceleration when the throttle is opened more than a predetermined amount in less than a predetermined time.

Figure 21:
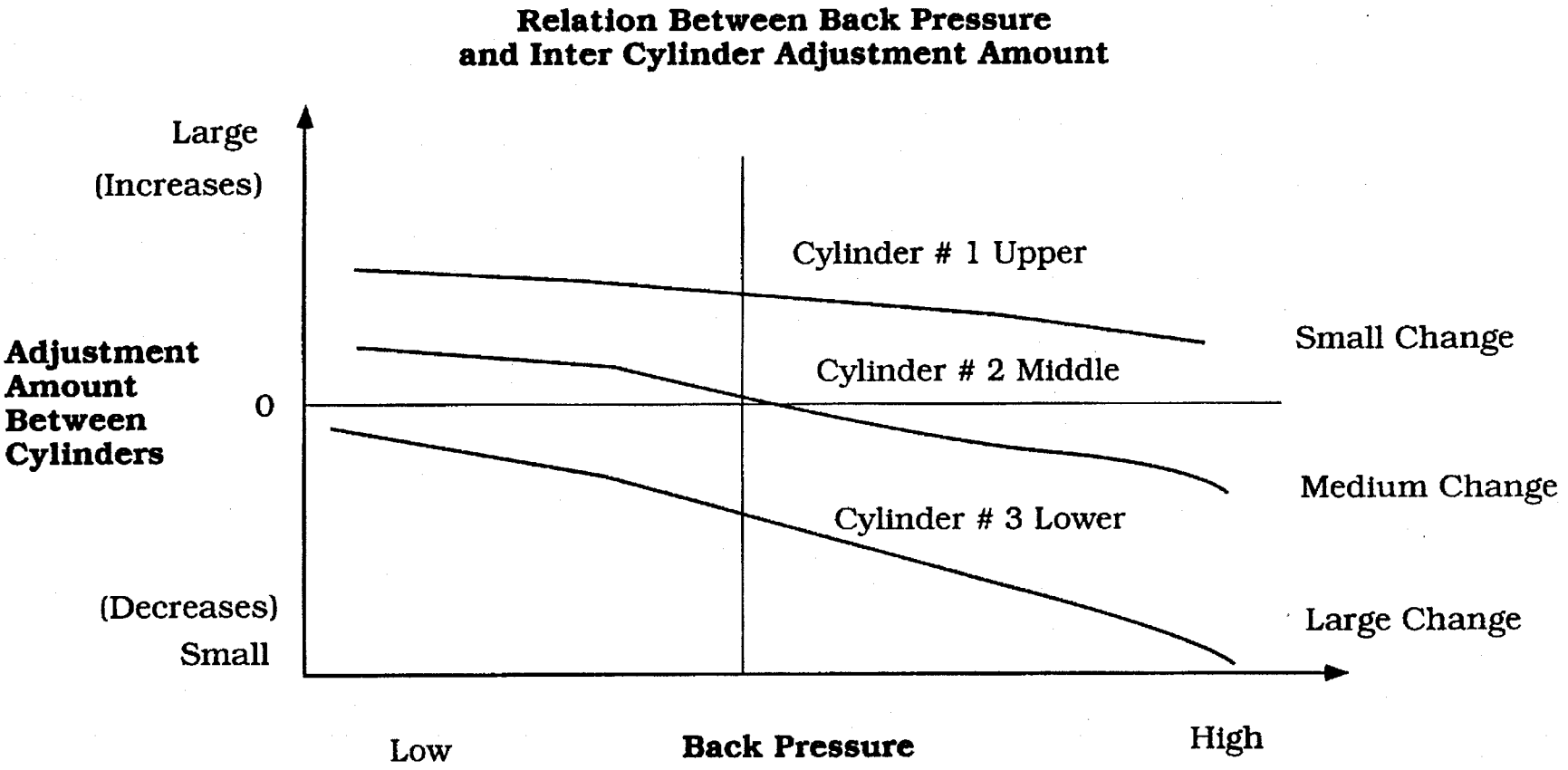
FIG. 21 is a graphical view showing how back pressure relates to adjustment amount between cylinder to cylinder fuel amount variations to compensate for the differences in the effective length of the exhaust pipe.

In addition to the factors which have already been discussed, it has also been discovered that the ideal air fuel ratio for the engine 12 varies cylinder by cylinder. Considering the number of cylinders as 1, 2 and 3, beginning at the top, it is found that since the exhaust manifold 41 which collects the exhaust gases from the exhaust port 39 must be relatively compact and, as is known, exhaust pulses are delivered back to the individual exhaust ports from the end of the exhaust pipe 44. The effect of this varies from cylinder to cylinder because of the fact that the exhaust ports 39 for each cylinder are disposed at different distance from the end of the exhaust pipe 44. The effect of this on both fuel injection adjustment amount is shown in FIG. 2, which shows the fuel injection amount adjustment required for each cylinder at varying back pressures. Hence, in addition to the corrections already noted, the amount of adjustment or correction for each cylinder must be different and the ECU 51 also includes a map that provides the appropriate corrections to accommodate this situation. These corrective values in fuel injection amount is shown in FIG. 21.

It will be seen that as the cylinder number moves from the top most cylinder (cylinder #1) to the lower most cylinder (cylinder #3) the amount of adjustment in relation to back pressure becomes larger. That is, the lower most cylinder and the one closest to the end of the exhaust pipe requires the large adjustment in fuel injection amount in relation to varying exhaust back pressures.

Figure 22:
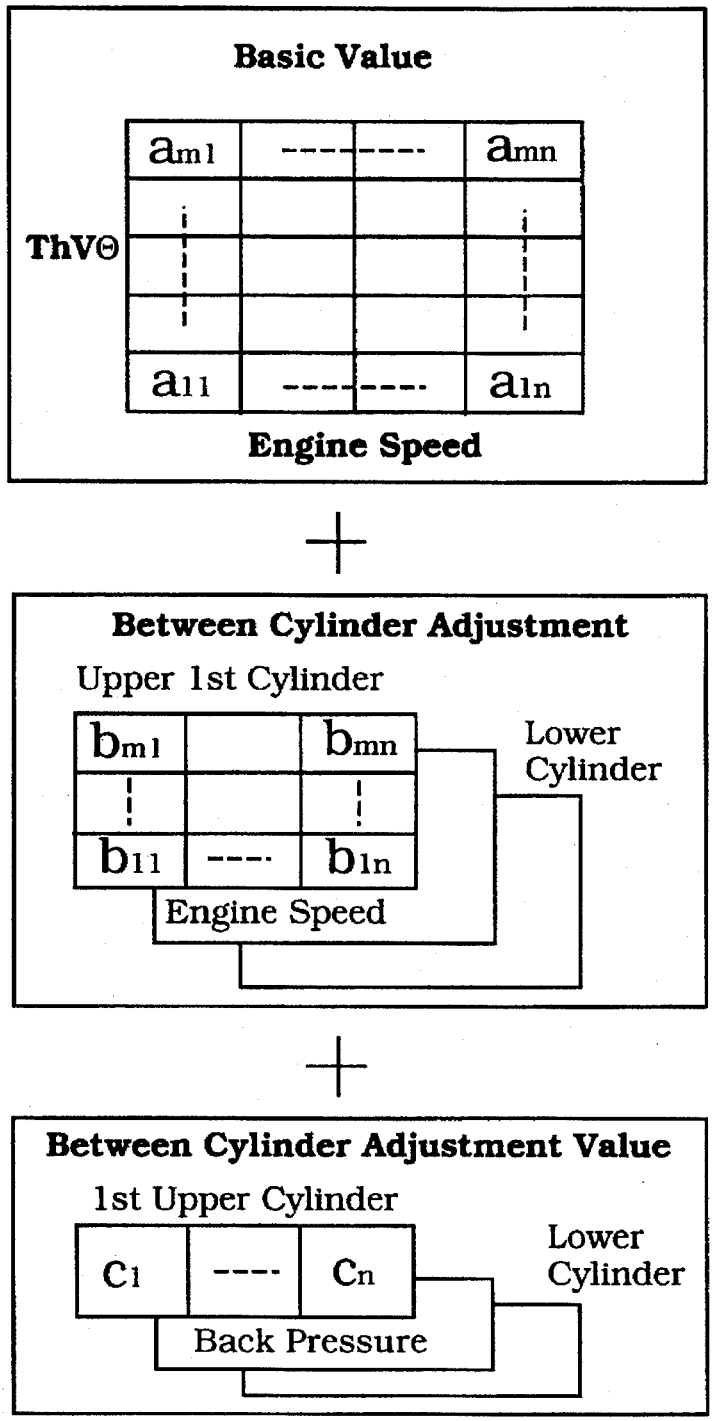
FIG. 22 is a graphical view showing three components (a), (b), & (c) utilized to calculate the fuel injection duration amount based upon engine speed, cylinder location and anticipated cylinder back pressure in order to compensate for all of these factors.
Figure 23:
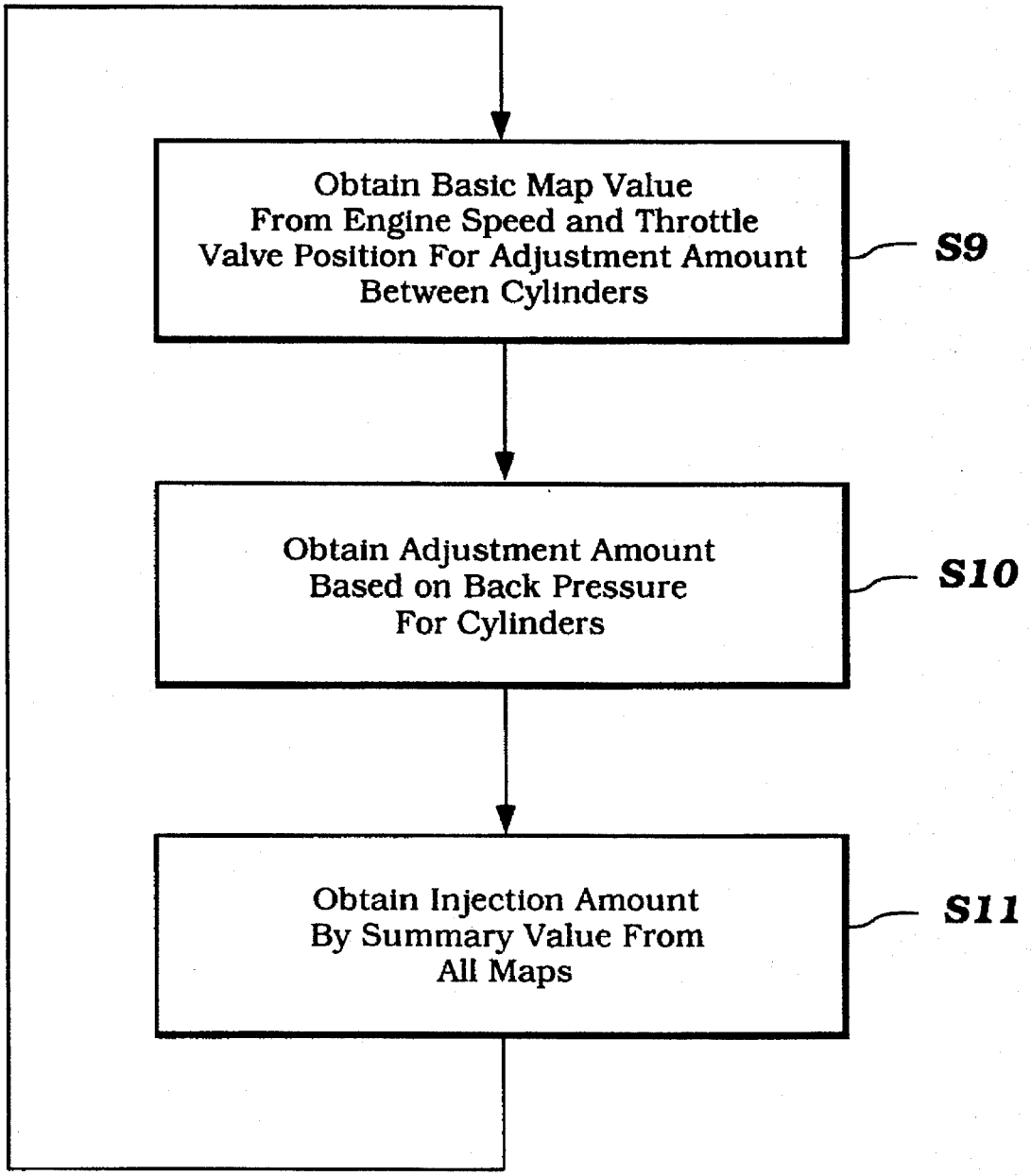
FIG. 23 is a control routine diagram showing the method by which the adjustment is made between cylinders from engine speed, throttle valve opening, and exhaust back pressure to determine the total fuel injection amount.

FIGS. 22 and 23 show, respectively, how the actual fuel injection amount per cylinder is varied in accordance with this portion of the controlled routine. FIG. 22 shows each of the look up maps which are consulted by the ECU 51 in calculating the actual fuel injection amount or duration for each cylinder while FIG. 23 shows the actual control routine which the ECU follows.

At the step S12 the ECU looks to the first map indicated at "a" in FIG. 22 after reading the actual engine speed and throttle valve angle to provide the basic fuel injection amount for each cylinder for the engine speed and load condition. In the map of Figure a and at the step S9, the actual fuel injection amount for each cylinder is set the same.

The program then moves to the step S10 so as to measure the actual between cylinder adjustment which is required by the actual engine speed which is measured and applies a first corrective factor at the step S10 to the value arrived at at the step S9.

Finally, the program moves to the step S11 and reads the map "c" of FIG. 22 to find the between cylinder adjustment required by the back pressure at each cylinder. The program then sets the fuel injection amount from the sums arrived at from the maps of a,b and c of FIG. 22.

In addition to these adjustments in fuel injection amount and as previously noted, individual cylinder to cylinder spark timing adjustments may also be made in accordance with these same principles.

The data thus far accumulated is data basically for a basic engine type. In actual production of a series or group of engines, the variation from engine to engine between cylinders can be different and FIGS. 24–27 show a methodology and control routine whereby the cylinder to cylinder adjustment may be compared with a basic map for the engine family and adjusted per individual engine.

Figure 24:
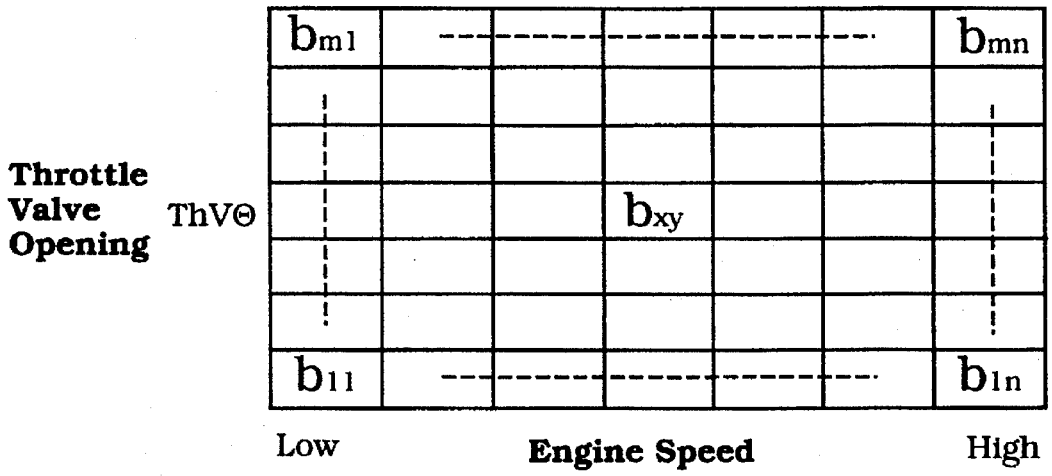
FIG. 24 is a map showing the adjustment between cylinders in fuel injection amount in response to engine speed and throttle valve opening.
Figure 25:
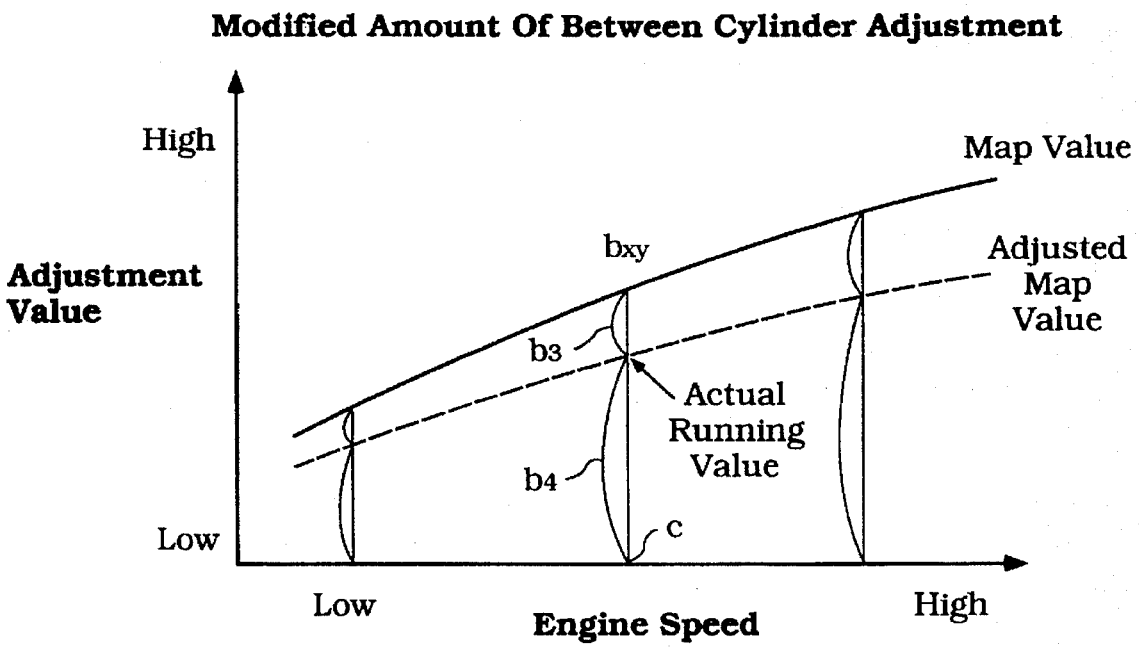
FIG. 25 is a graphical view showing another alternative way of providing between cylinder adjustment in response to engine speed for a specific engine relative to a base engine.
Figure 26:
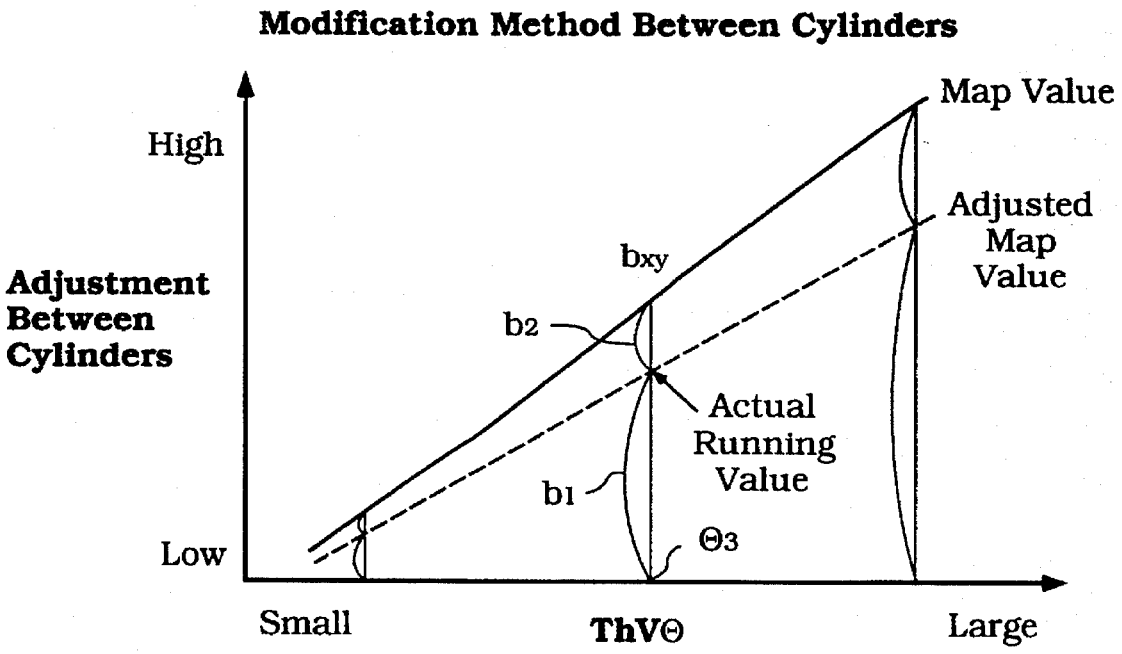
FIG. 26 is a graphical view showing another between cylinder adjustment amount made in response to variations in throttle valve opening for a specific engine relative to a base engine.

FIG. 24 shows the basic map for all cylinders of the engine in relation to throttle valve opening and engine speed for cylinder to cylinder adjustment. However, from the map value generated from FIG. 24, between cylinder adjustments may be made based on actual engine running for a given engine based upon engine speed as shown in FIG. 2B and throttle valve opening as shown in FIG. 26 on an engine to engine modification.

Figure 27:
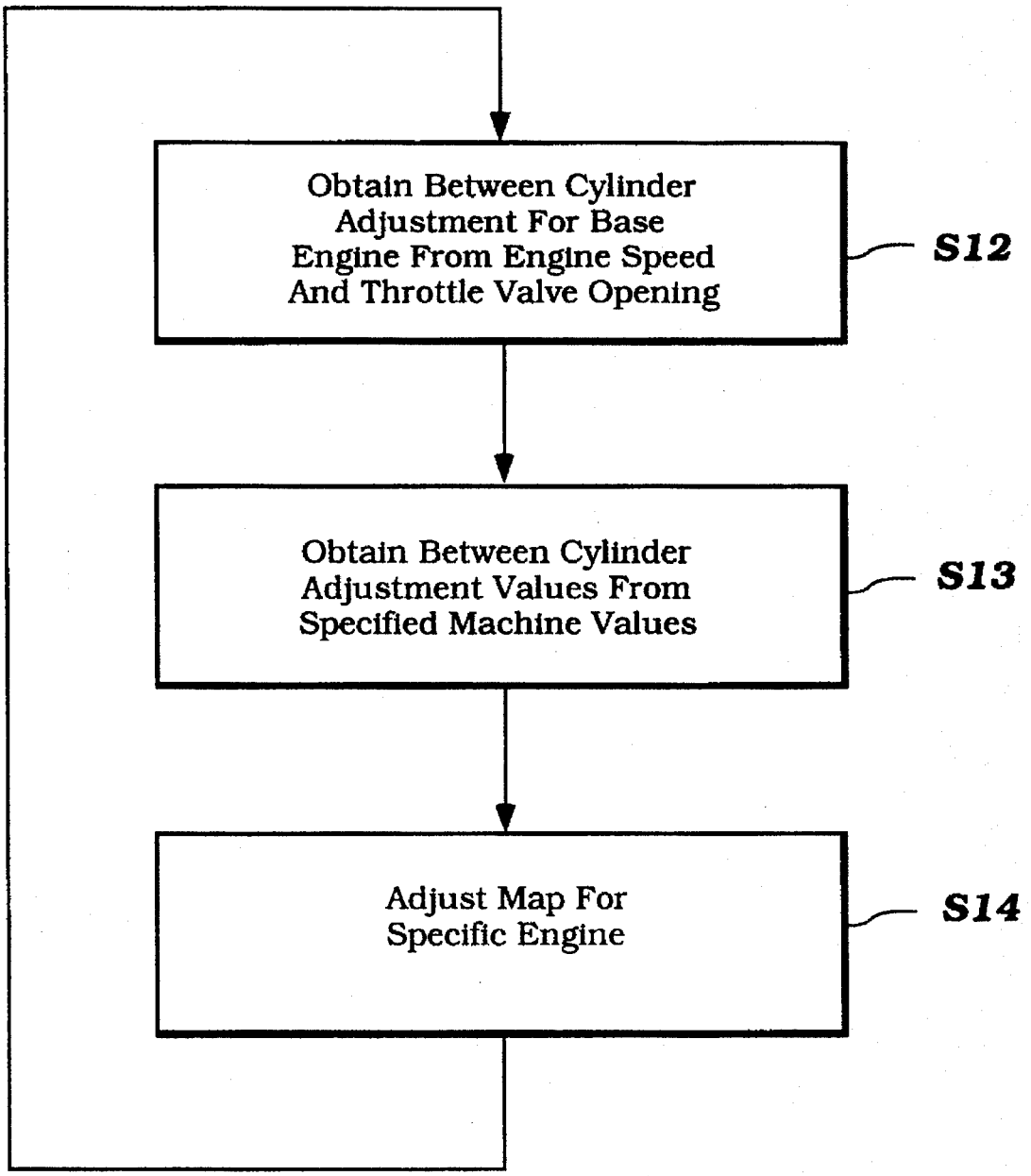
FIG. 27 is a control routine diagram showing the method by which the adjustment is made between cylinders from engine speed, throttle valve opening and back pressure to determine the total fuel injection amount for a specific engine relative to a base engine.

Thus, utilizing a control routine as shown in FIG. 27 at the step S12 the basic cylinder to cylinder adjustment based upon engine speed and throttle valve opening is read. The program then moves to the step S13 so as to obtain the cylinder to cylinder adjustments from actual running characteristics as derived by the data accumulated from FIGS. 25 and 26 and then at the step S14 the actual mapping of the engine is adjusted so as to compensate for the measured value for the particular engine.

It should be readily apparent from the foregoing description that the described embodiments are very effective in meeting the objects as set forth. Of course, various changes and modifications may be made without departing from the spirit and scope of the invention, as defined by the appended claims.

We claim:

1. A control method for a marine propulsion system for propelling a hull, an internal combustion engine carried by said hull and comprised of a combustion chamber, an air and charge forming system for supplying a fuel air charge to said engine combustion chamber for combustion therein for driving a propulsion device carried by said hull for propelling said hull, an exhaust system for discharging combustion products from said combustion chamber to the atmosphere, a combustion sensor for sensing the combustion condition in said combustion chamber, and a hull condition sensor for sensing a hull condition that will affect combustion, said method comprising the steps of reading the output of the combustion condition sensor, adjusting at least one of the engine systems in response to the output of the combustion condition sensor to maintain the desired combustion condition, sensing the hull condition that may effect the combustion, and adjusting at least one of the engine systems in response to the sensed hull condition for compensating for variations in hull condition.

2. A control method for a marine propulsion, internal combustion engine as set forth in claim 1, wherein the hull condition sensed is a condition that will affect back pressure in the exhaust system.

3. A control method for a marine propulsion, internal combustion engine as set forth in claim 1, wherein an exhaust outlet of the exhaust system is associated with the propulsion device for propelling the hull and means are provided for changing the relation of the propulsion device and exhaust outlet relative to the hull.

4. A control method for a marine propulsion, internal combustion engine as set forth in claim 3, wherein the hull condition sensed is the relative position of the exhaust outlet and the propulsion device relative to the hull.

5. A control method for a marine propulsion, internal combustion engine as set forth in claim 4, wherein the relative position is determined by a trim sensor.

6. A control method for a marine propulsion, internal combustion engine as set forth in claim 5, wherein the propulsion device and exhaust outlet are pivotally supported on the vessel and the sensing device senses the pivotal position.

7. A control method for a marine propulsion, internal combustion engine as set forth in claim 4 wherein the lift of the propulsion device and the exhaust outlet are adjusted relative to the hull.

8. A control method for a marine propulsion, internal combustion engine as set forth in claim 7 wherein the hull condition sensed is the lift of the propulsion device and the exhaust outlet.

9. A control method for a marine propulsion, internal combustion engine as set forth in claim 1 wherein the engine system adjusted is the air and fuel charging system.

10. A control method for a marine propulsion, internal combustion engine as set forth in claim 9, wherein the engine is spark ignited and further including a spark control system for controlling the time at which the spark plug is fired.

11. A control method for a marine propulsion, internal combustion engine as set forth in claim 10, wherein the spark timing is also adjusted in response to the sensed hull condition that effects the combustion in the engine.

12. A control method for a marine propulsion, internal combustion engine as set forth in claim 1, wherein the engine is a two-cycle, crankcase compression engine.

13. A control method for a marine propulsion, internal combustion engine as set forth in claim 1, wherein the watercraft condition sensed is hull speed.

14. A control method for a marine propulsion, internal combustion engine as set forth in claim 1, wherein the watercraft condition sensed is acceleration.

15. A control method for a marine propulsion, internal combustion engine as set forth in claim 1, wherein a plurality of hull conditions are sensed.

16. A control method for a marine propulsion, internal combustion engine as set forth in claim 15, wherein at least one of the hull conditions sensed is a condition that will affect back pressure in the exhaust system.

17. A control method for a marine propulsion, internal combustion engine as set forth in claim 16, wherein the propulsion device and exhaust outlet are pivotally supported on the vessel and the sensing device senses the pivotal position.

18. A control method for a marine propulsion, internal combustion engine as set forth in claim 16, wherein the lift of the propulsion device and the exhaust outlet are adjusted relative to the hull.

19. A control method for a marine propulsion, internal combustion engine as set forth in claim 18, wherein the at least one hull condition sensed is the lift of the propulsion device and the exhaust outlet.

20. A control method for a marine propulsion, internal combustion engine as set forth in claim 16, wherein the at least one watercraft condition sensed is hull speed.

21. A control method for a marine propulsion, internal combustion engine as set forth in claim 16, wherein the at least one watercraft condition sensed is acceleration.

22. A control method for a marine propulsion, internal combustion engine as set forth in claim 1, wherein the engine has a plurality of cylinders, each being served by a respective exhaust port and the exhaust system.

23. A control method for a marine propulsion, internal combustion engine as set forth in claim 22, wherein the exhaust system comprises a collector section for collecting the exhaust gases from all of the exhaust ports and delivering them to the exhaust outlet, and wherein each of the exhaust ports is spaced at a distance from the exhaust outlet different from the others.

24. A control method for a marine propulsion, internal combustion engine as set forth in claim 23, wherein the air and fuel charging system comprises a plurality of fuel supply devices, each supplying fuel to a respective combustion chamber and wherein the amount of fuel supplied by each fuel supply device is varied depending upon the distance of the exhaust port from the exhaust outlet.

25. A control method for a marine propulsion, internal combustion engine as set forth in claim 24, wherein the hull condition sensed is a condition that affects exhaust back pressure.

26. A control method for a marine propulsion, internal combustion engine as set forth in claim 25, wherein the engine is spark ignited and further including a spark control system for controlling the time at which the spark plug is fired.

27. A control method for a marine propulsion, internal combustion engine as set forth in claim 26, wherein the spark timing is also adjusted in response to the sensed condition that effects the back pressure in the exhaust system.

28. A control method for a marine propulsion, internal combustion engine as set forth in claim 27 wherein the combustion chamber systems are adjusted independently of each other.

* * * * *